US006391511B1

(12) United States Patent
Okamoto et al.

(10) Patent No.: US 6,391,511 B1
(45) **Date of Patent: *May 21, 2002**

(54) DEVELOPING APPARATUS, APPARATUS UNIT, AND IMAGE FORMING METHOD

(75) Inventors: Naoki Okamoto, Numazu; Yasuhide Goseki, Yokohama; Masayoshi Shimamura, Yokohama; Kenji Fujishima, Yokohama; Kazunori Saiki, Yokohama; Satoshi Otake, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/290,266

(22) Filed: Apr. 13, 1999

(30) Foreign Application Priority Data

Apr. 17, 1998 (JP) ..... 10-107941

(51) Int. Cl.[7] ..... G03G 9/08
(52) U.S. Cl. ..... 430/120; 399/260; 399/276
(58) Field of Search ..... 430/120; 399/260, 399/276

(56) References Cited

U.S. PATENT DOCUMENTS

| | | | | |
|---|---|---|---|---|
| 5,175,586 A | 12/1992 | Goseki et al. | ..... | 355/259 |
| 5,274,426 A | 12/1993 | Goseki et al. | ..... | 355/259 |
| 5,547,724 A | 8/1996 | Kuribayashi | ..... | 428/35.8 |
| 5,618,647 A | 4/1997 | Kukimoto et al. | ..... | 430/106.6 |

FOREIGN PATENT DOCUMENTS

| | | |
|---|---|---|
| EP | 0 458 603 | 11/1991 |
| EP | 0 810 492 | 12/1997 |
| JP | 1-112253 | 4/1989 |
| JP | 1-277256 | 11/1989 |
| JP | 2-284158 | 11/1990 |
| JP | 3-36570 | 2/1991 |
| JP | 5-232793 | 9/1993 |
| JP | 7-114270 | 5/1995 |
| JP | 9-244398 | 9/1997 |
| JP | 9-325616 | 12/1997 |

*Primary Examiner*—Mark Chapman
(74) *Attorney, Agent, or Firm*—Fitzpatrick, Cella, Harper & Scinto

(57) ABSTRACT

A developing apparatus has a developer container for holding a developer, a developer carrying member for carrying a positively chargeable developer held in the developer container and transporting the developer to a developing zone and a developer layer-thickness regulating member for regulating the thickness of a positively chargeable developer layer to be formed on the developer carrying member. The developer carrying member has at least a substrate and a resin coat layer formed of a resin composition on the surface of the substrate. The resin composition contains at least (I) a binder resin, (II) a conductive fine powder, (III) spherical particles having a number-average particle diameter of from 0.3 $\mu$m to 30 $\mu$m and (IV) a quaternary ammonium salt compound which is positively chargeable to iron powder.

119 Claims, 7 Drawing Sheets

DEVELOPING APPARATUS, APPARATUS UNIT, AND IMAGE FORMING METHOD

BACKGROUND OF THE INVENTION

1. Field of the Invention

This invention relates to a developing apparatus, an apparatus unit and an image forming method by which an electrostatic latent image formed on an electrostatic latent image bearing member used in electrophotography, electrostatic recording or magnetic recording is developed to render it visible by the use of a developer carried and transported on a developer carrying member.

2. Related Background Art

A number of methods are conventionally known as electrophotography. In general, copies are obtained by forming an electrostatic latent image on an electrostatic latent image bearing member (photosensitive member) by utilizing a photoconductive material and by various means, subsequently developing the electrostatic latent image by the use of a developer having a toner, to make it visible to form a toner image, transferring the toner image to a transfer medium such as paper as occasion calls, and then fixing the toner image to the transfer medium by the action of heat, pressure or the like.

Development systems in electrophotography are chiefly grouped into one-component type development and two-component type development. In recent years, electrophotographic apparatus are demanded to be made light-weight and small-sized. Accordingly, since the part of a developing apparatus or assembly must be made small, a developing apparatus employing a one-component type development carried out using one-component type developers are used in many cases.

More specifically, such one-component type development systems require no carrier particles such as glass beads or iron powder required in two-component type development systems, and hence can make developing assemblies themselves small-sized and light-weight. Also, since in the two-component type development systems the concentration of toner in the two-component type developer must be kept constant, a device for detecting toner concentration so as to supply the toner in the desired quantity is required, thus, in the case of the two-component type development systems, this also tends to make developing assemblies have larger size and weight. On the other hand, in the one-component type development systems, such a device is not required, and hence the developing assemblies can also be made small-sized and light-weight.

Known as the one-component type development system making use of one-component type developers is, e.g., a system in which an electrostatic latent image is formed on a photosensitive drum serving as a latent image bearing member, positive or negative electric charges are imparted to a toner serving as a one-component type developer, by the friction between a developing sleeve as a developer carrying member and the toner and/or the friction between a developer layer-thickness regulating member for regulating toner coat quantity on the developing sleeve and the toner, then, by this developing sleeve thin coated with the toner on its surface, the toner standing positively or negatively charged is transported to a developing zone at which the photosensitive drum and the developing sleeve face each other, and in the developing zone the toner is caused to fly and adhere to the electrostatic latent image formed on the surface of the photosensitive drum, to perform development to make the electrostatic latent image visible as a toner image.

The one-component type developers used in such one-component type development system include a one-component type magnetic developer containing a magnetic material for making the one-component type developer carried on the developer carrying member chiefly by the action of magnetic force, and a one-component type non-magnetic developer containing no magnetic material. In the latter case, the one-component type non-magnetic developer is carried on the developer carrying member chiefly by the action of electrostatic force. The one-component type developers also include, from their charge polarities, those having a negatively chargeable toner and those having a positively chargeable toner. Then, when, e.g., development is performed on an OPC (organic photoconductor) photosensitive member holding on its surface a negatively charged electrostatic latent image, a developer having a positively chargeable toner is used when what is called regular development is performed, and a developer having a negatively chargeable toner is used when what is called reverse development is performed. Negatively charging OPC photosensitive members are widely used because they have stable performance and are available at a low price. Thus, in printers and digital copying machines, the developer having a negatively chargeable toner is used in many cases since the reverse development is performed. In analog copying machines which performs regular development, the developer having a positively chargeable toner is used in many cases since the regular development is performed.

As the developer carrying member having the function to carry and transport such a developer on the surface when the development is performed, a member is used which is produced by molding, e.g., a metal, an alloy or compound thereof into a cylinder and treating its surface by electrolysis, blasting or filing so as to have a stated surface roughness. When, however, the developer carrying member made of such a material is used and the developer layer is regulated by the developer layer-thickness regulating member into a thin layer and formed on the developer carrying member surface, the developer present on the developer carrying member surface and in the vicinity thereof comes to have a very high electric charge, so that it is strongly attracted to the developer carrying member surface by the action of mirror force. This makes the toner particles have no opportunity of their friction with the developer carrying member, and hence the developer comes to have no preferable electric charges (a phenomenon called "charge-up"). Under such a condition, no satisfactory development and transfer can be performed, resulting in images with much uneven image density and many black spots around line images. Moreover, the toner attracted to the surface of the developer carrying member by such mirror force may trigger spot-like images, what is called blotches which may occur on and adhere to the developer carrying member, or may cause melt-adhesion of toner.

In recent years, developers (toners) are sought to be fixable at a lower temperature for the purpose of energy saving. In such a case, too, it is desired to form highly minute images. In order to realize the fixing of toner at a low temperature, there is, e.g., a tendency that when toners are produced the Tg (glass transition temperature) of the developer is set a little lower or a low-molecular weight component or a low-melting substance such as wax is added to a binder resin in a little larger quantity. When, however, such a toner is used in image formation, the developer tends to melt-adhere to the surface of the developer carrying member because of temperature rise or physical action of the body of an apparatus, consequently tending to cause a decrease in image density, images with white lines and blotchy images.

Japanese Patent Application Laid-open No. 1-112253 and No. 2-284158 disclose a proposal of using toners having small particle diameters so that image quality can be made higher and images can be made more highly minute. Such toners having small particle diameters, however, have a larger surface area per unit weight, and hence tend to have a larger electric charge on the surface, where the toner may stick or adhere to the surface of the developer carrying member because of the phenomenon of what is called "charge-up", so that the toner fed afresh onto the developer carrying member can be charged with difficulty. In such a case, the toner tends to have a nonuniform charge quantity. This tends to cause sleeve ghost on images, and the resultant images tend to be formed as nonuniform images such as images with lines and fogged images in solid black images and halftone images.

In order to prevent occurrence of such a toner having excessive electric charges and prevent strong adhesion of toner to the developer carrying member, as disclosed in Japanese Patent Application Laid-open No. 1-277256 and No. 3-36570 a method is proposed in which a developer carrying member is formed of a substrate and a coat layer and a conductive material such as carbon black or graphite powder or a solid lubricant is dispersed in the coat layer.

However, this method may be insufficient if employed alone. For example, in recent years, members brought into contact with the photosensitive member are often used in image forming processes. In such a case, a difficulty as stated below may occur. As members brought into contact with the photosensitive member, there are, e.g., a charging member such as a charging rubber roller, a transfer member such as a transfer sponge roller, and a cleaning member such as a cleaning rubber blade. When these members are used, these members come into contact with the photosensitive member, and hence the toner remaining on the photosensitive member or the toner having adhered to these members is pressed against the photosensitive member to tend to cause filming or melt-adhesion.

As a measure against it, as disclosed in Japanese Patent Application Laid-open No. 9-244398 and No. 9-325616, a method is proposed in which a liquid lubricant as exemplified by silicone oil is used in such a way that it is supported on toner constituent materials. As the toner constituent materials made to have the silicone oil supported thereon, there are a magnetic material, a colorant, a charge control agent and also silica used as an external additive, any of which may be used alone or in plurality as so reported. The toner constituted in such a way can be improved in releasability, and not only is effective for preventing, or making less occur, the filming or melt-adhesion stated above, but also can be improved in transfer performance to enable prevention of the phenomenon of blank areas caused by poor transfer (a phenomenon in which the inner area of a line or character image having been transferred is not transferred and stands blank in white). Thus, this is preferably used. However, such a toner in which a liquid lubricant is supported on toner constituent materials tends to have an excessively high charge quantity, and hence tends to cause the phenomenon of charge-up. Especially in the positively chargeable toner, this tendency is strong because the chargeability of the toner has a great dependence on the charge control agent to be added and the external additive to be externally added.

Japanese Patent Application Laid-open No. 5-232793 discloses a developing apparatus comprising a developer carrying member having as a surface layer a resin coat layer which contains at least resin, graphite and carbon black and is so formed that a charge control agent is present in the surface layer and in the vicinity thereof, in order to control the chargeability to toner. Also, as the charge control agent, exemplified are various charge control agents including quaternary ammonium salts. As the resin used in the coat layer formed on the developer carrying member, exemplified are various resins including phenol resins, polyamide resins and polyurethane resins.

However, stated specifically, this prior art shows an Example in which development is carried out using a negatively chargeable toner on the developer carrying member having a resin coat layer employing a phenol resin as the resin and nigrosine as the charge control agent. It has no disclosure at all as to an instance where positively chargeable toners are used and also has neither disclosure nor suggestion at all as to how, in such an instance, positive triboelectric charges can preferably be imparted to the toner when in what combination the resin and the charge control agent are used.

Meanwhile, for the purpose of imparting a high positive charge to toner, Japanese Patent Application Laid-open No. 7-114270 discloses a charge-providing member for developing electrostatic latent images which have at least at part of the surface a quaternary ammonium salt compound having a specific structure. It discloses that the above compound is used together with optionally a binder resin or molding resin component to form a coat layer. As the binder resin or molding resin component, used are styrene resins, styrene-acrylic copolymer resins, polystyrene resins, epoxy resins and mixed resins of any of these, or any of these having an amino group on the alkyl side chain. In its Examples, a styrene-acrylate copolymer resin is used.

However, the developer carrying member having such a coat layer as a charge-providing member may cause contamination by toner or melt-adhesion of toner during many-sheet running, and is sought to be more improved in running performance of the developer carrying member. In addition, according to studies made by the present inventors, in the case of a developer carrying member on which such a coat layer is formed using the quaternary ammonium salt compound and the styrene-acrylate copolymer resin in combination, the quaternary ammonium salt compound is present only in the state it is merely dispersed in the styrene-acrylate copolymer resin. Thus, as shown in Comparative Examples given later in the part of Examples of the present invention, the charging property of the coat layer thus formed is positive chargeability, and hence the ability to impart positive triboelectric charges to positively chargeable toners is also not sufficient.

SUMMARY OF THE INVENTION

Accordingly, an object of the present invention is to provide a developing apparatus, an apparatus unit and an image forming method which, in the development of electrostatic latent images by the use of a positively chargeable toner, can make stable the positive-charge-providing properties to toner, may hardly cause any excessive charging of toner and melt-adhesion or contamination of toner onto the developer carrying member, and may hardly cause the image density decrease, faulty images and faulty toner coat (blotches) which may otherwise consequently be caused.

Another object of the present invention is to provide a developing apparatus, an apparatus unit and an image forming method which can form stable images even in repeated image reproduction, and enables development promising a good environmental stability.

To achieve the above objects, the present invention provides a developing apparatus comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein;

the developer carrying member has at least a substrate and a resin coat layer formed of a resin composition on the surface of the substrate;

the resin composition containing at least (I) a binder resin, (II) a conductive fine powder, (III) spherical particles having a number-average particle diameter of from 0.3 $\mu$m to 30 $\mu$m and (IV) a quaternary ammonium salt compound which is positively chargeable to iron powder.

The present invention also provides an apparatus unit detachably mountable on the main assembly of an image forming apparatus; the unit comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein;

the developer carrying member has at least a substrate and a resin coat layer formed of a resin composition on the surface of the substrate;

the resin composition containing at least (I) a binder resin, (II) a conductive fine powder, (III) spherical particles having a number-average particle diameter of from 0.3 $\mu$m to 30 $\mu$m and (IV) a quaternary ammonium salt compound which is positively chargeable to iron powder.

The present invention still also provides an image forming method comprising the steps of;

a latent image forming step of forming an electrostatic latent image on a latent image bearing member; and a developing step of developing the electrostatic latent image by the use of a positively chargeable developer of a developing apparatus;

wherein;

in the developing step, the electrostatic latent image is developed by means of the developing apparatus, which comprises;

a developer container for holding a positively chargeable developer;

a developer carrying member for carrying the positively chargeable developer held in the developer container and transporting the developer to a developing zone, wherein;

the developer carrying member has at least a substrate and a resin coat layer formed of a resin composition on the surface of the substrate; the resin composition containing at least (I) a binder resin, (II) a conductive fine powder, (III) spherical particles having a number-average particle diameter of from 0.3 $\mu$m to 30 $\mu$m and (IV) a quaternary ammonium salt compound which is positively chargeable to iron powder; and a developer layer-thickness regulating member for regulating the thickness of a positively chargeable developer layer to be formed on the developer carrying member;

the positively chargeable developer being triboelectrically charged by its friction with the surface of the developer carrying member so that positive triboelectric charges are imparted to the positively chargeable developer, and the electrostatic latent image being developed by the use of the positively chargeable developer to which the positive triboelectric charges have been imparted.

DESCRIPTION OF THE PREFERRED EMBODIMENTS

Figure 1:
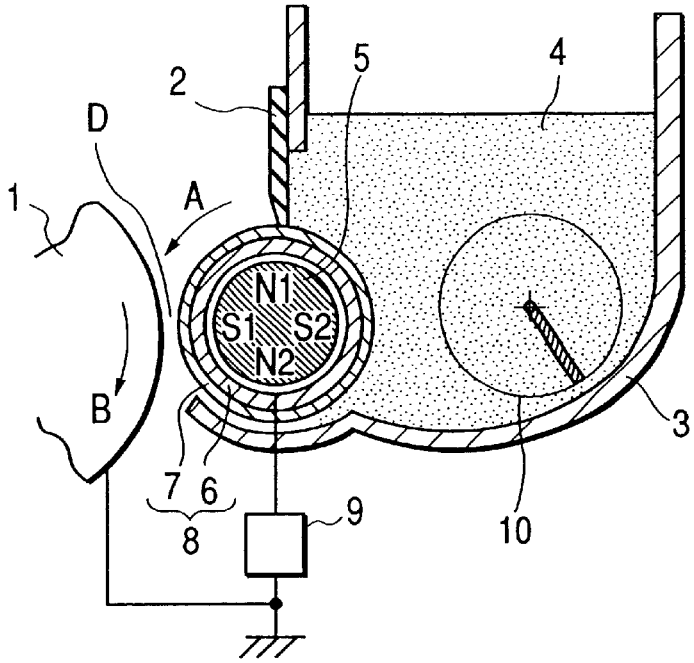
FIG. 1 is a diagrammatic view of a developing apparatus in which a developer carrying member having a resin coat layer and, as a developer layer-thickness regulating member, a magnetic blade are used.

The present invention will be described below in detail by discussing preferred embodiments.

The present inventors made extensive studies in order to solve the above problems the prior art has had. As the result, they have discovered that a developer carrying member for carrying a positively chargeable developer may be constituted of at least a substrate and a resin coat layer provided thereon, and also the resin coat layer may be formed using a resin composition containing at least (I) a binder resin, (II) a conductive fine powder, (III) spherical particles having a number-average particle diameter of from 0.3 $\mu$m to 30 $\mu$m and (IV) a quaternary ammonium salt compound which is positively chargeable to iron powder, whereby the problems the prior art has had can be solved without difficulty. Thus, they have accomplished the present invention.

More specifically, among quaternary ammonium salt compounds, the quaternary ammonium salt compound which is positively chargeable to iron powder is incorporated in the structure of a specific binder resin which is a film forming component. This makes the resin coat layer itself a substance readily negatively chargeable, so that its positive-charge-providing performance to the positively chargeable developer can be improved. In addition, the conductive fine powder stands added to the resin coat layer. This makes electric charges not stagnate on the developer carrying member surface, and hence the toner can be kept from being strongly attracted by the action of mirror force. Moreover, the spherical particles having a number-average particle diameter of from 0.3 $\mu$m to 30 $\mu$m are added in the resin coat layer. This can make stable the surface roughness of the developer carrying member, bringing about advantages that the coat quantity of the toner carried on the developer carrying member can be optimized and at the same time the surface roughness of the resin coat layer can be made to less change even if the resin coat layer surface has worn and also that the contamination by toner or melt-adhesion of toner can be made to hardly occur. The incorporation of the above spherical particles also brings about advantages that the effect of rapid and uniform charge-providing action and charge control to the positively chargeable developer can be more improved by virtue of mutual action and also the charging performance can be made stable; the effect being achieved by a binder resin contained in the resin coat layer, especially by a specific binder resin having the structure of any of an —$NH_2$ group, an =NH group and an —NH— linkage as described later, and by the quaternary ammonium salt compound.

According to studies made by the present inventors, in addition to the foregoing, it has been found that the use of the spherical particles, in particular, conductive spherical particles and those having a true density of 3 g/cm$^3$ or below, enables the developer to be more uniformly coated on the developer carrying member and, as the result, its wear resistance and environmental stability can be improved to make it possible to obtain good images even in the running over a long term. It has also been found that as the binder resin constituting the resin coat layer the use of a binder resin having in part or entirely at least any of an —$NH_2$ group, an =NH group and an —NH— linkage makes it easy for the above quaternary ammonium salt compound which is positively chargeable to iron powder, to be incorporated in the molecular structure, and hence makes the resin coat layer itself a substance readily negatively chargeable, so that its positive-charge-providing performance to the positively chargeable developer can be improved.

In addition to the developer carrying member having such a specific resin coat layer, the positively chargeable developer to be carried thereon may be a one-component type positively chargeable developer having a toner to which an external additive treated with a liquid lubricant and/or a one-component type positively chargeable developer having a toner containing a magnetic powder having a liquid lubricant supported thereon. This makes the positively chargeable developer more preferably chargeable.

As described above, in the developer carrying member used in the present invention, a thin layer of the positively chargeable developer is formed on its surface, and this thin layer is carried and transported thereon. This developer will be described below.

The positively chargeable toner of the positively chargeable developer comprises as chief materials a binder resin, a release agent, a charge control agent and a colorant. Usually, it is a fine power comprised of a colored resin composition which is obtained by melt-kneading these materials, followed by cooling to solidify, and thereafter pulverizing the resultant kneaded product, optionally further followed by classification to adjust particles to have the desired particle size distribution.

As the binder resin for toner, used in the positively chargeable toner used in the present invention, commonly known resins may be used.

The binder resin for toner may include, e.g., styrene, homopolymers of styrene or derivatives thereof such as α-methylstyrene and p-chlorostyrene; styrene copolymers such as a styrene-propylene copolymer, a styrene-vinyltoluene copolymer, a styrene-ethyl acrylate copolymer, a styrene-butyl acrylate copolymer, a styrene-octyl acrylate copolymer, a styrene-dimethylaminoethyl copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-methyl vinyl ketone copolymer, a styrene-butadiene copolymer, a styrene-isoprene copolymer, a styrene-maleic acid copolymer, and a styrene-maleic acid ester copolymer; polymethyl methacrylate; polybutyl methacrylate; polyvinyl acetate; polyethylene; polypropylene; polyvinyl butyral; polyacrylic resins; rosin; modified rosins; terpene resins; phenol resins; aliphatic or alicyclic hydrocarbon resins; aromatic petroleum resins; paraffin wax; and carnauba wax. Any of these may be used alone or in the form of a mixture.

In the positively chargeable toner used in the present invention, any of pigments given below may be incorporated as the colorant. For example, usable are carbon black, Nigrosine dyes, lamp black, Sudan Black SM, Fast Yellow G, Benzidine Yellow, Pigment Yellow, Indian First Orange, Irgazine Red, Para Nitroaniline Red, Toluidine Red, Carmine 6B, Permanent Bordeaux FRR, Pigment Orange R, Lithol Red 2G, Lake Red C, Rhodamine FB, Rhodamine B Lake, Methyl Violet B lake, Phthalocyanine Blue, Pigment Blue, Brilliant Green B, Phthalocyanine Green, Oil Yellow GG, Zapon First Yellow CGG, Kayaset Y963, Kayaset YG, Zapon First Orange RR, Oil Scarlet, Aurazole Brown B, Zapon First Scarlet CG, and Oil Pink OP.

When the positively chargeable toner used in the present invention is used as a magnetic toner, a magnetic powder is incorporated in the toner. As the magnetic powder, a material magnetizable when placed in a magnetic field is used. Stated specifically, the magnetic powder may include, e.g., powders of ferromagnetic metals such as iron, cobalt and nickel; alloys or mixtures of any of these ferromagnetic metals with other metal such as aluminum, cobalt, copper, lead, magnesium, tin, zinc, antimony, beryllium, bismuth, calcium, manganese, selenium, titanium, tungsten or vanadium; iron oxides such as magnetite, hematite and ferrite; and magnetic iron oxides the particle surfaces or insides of which contain oxides, hydrated oxides or hydroxides of metal ions such as silicon ions, aluminum ions or magnesium ions of such metal ions. This magnetic powder may be contained in an amount of from about 15 to 70% by weight based on the weight of the toner.

As mentioned previously, the present invention can be made more highly effective especially when the positively chargeable developer has a toner to which an external additive treated with a liquid lubricant has been added, or when it has a toner containing a colorant having a liquid lubricant supported thereon and/or a magnetic powder having a liquid lubricant supported thereon. The liquid lubricant for imparting the releasability and lubricity to the external additive, colorant or magnetic powder used in the toner may include animal oil type lubricants, vegetable oil type lubricants, petroleum type lubricants and synthetic lubricants. Synthetic lubricants may preferably be used in view of its stability.

The synthetic lubricants may include, e.g., silicones such as dimethylsilicone, methylphenylsilicone, and modified silicone of various types; polyol esters such as pentaerythritol ester and trimethylolpropane ester; polyolefins such as polyethylene, polypropylene, polybutene and poly(α-olefin); polyglycols such as polyethylene glycol and polypropylene glycol; silicic esters such as tetradecyl silicate and tetraoctyl silicate; diesters such as di-2-ethylhexyl sebacate and di-2-ethylhexyl adipate; phosphoric esters such as tricresyl phosphate and propylphenyl phosphate; fluorinated hydrocarbons such as polychlorotrifluoroethylene, polytetrafluoroethylene, polyvinylidene fluoride and polyethylene fluoride; polyphenyl ethers, alkylnaphthenes, and alkyl aromatics. In particular, in the present invention, from the viewpoint of thermal stability and oxidation stability, silicones and fluorinated hydrocarbons are preferred.

The silicones may include reactive silicones such as amino-modified silicone, epoxy-modified silicone, carboxyl-modified silicone, carbinol-modified silicone, methacryl-modified silicone, mercapto-modified silicone, phenol-modified silicone and heterofunctional-group-modified silicone; non-reactive silicones such as polyether-modified silicone, methylstyryl-modified silicone, alkyl-modified silicone, fatty-acid-modified silicone, alkoxy-modified silicone and fluorine-modified silicone; and straight silicones such as dimethylsilicone, methylphenylsilicone and methylhydrogensilicone.

In the present invention, the liquid lubricant as listed above is used so that, by the use of the liquid lubricant, the liquid lubricant supported on the particle surfaces of the external additive, colorant or magnetic powder can be partly liberated to become present on the surfaces of the toner particles and thereby exhibits the effect of imparting releasability and lubricity. Hence, curable silicone oils are less effective on account of their nature. Reactive silicones or silicones having polar groups may be strongly adsorbed on the colorant or magnetic powder serving as the supporting medium of the liquid lubricant, or may become compatible with the binder resin, so that they may be liberated in a small quantity depending on the degree of adsorption or compatibility, and can not be so effective in some cases. Non-reactive silicone oils may also become compatible with the binder resin, depending on the structure of the side chain, and may less move to the toner particle surfaces to become less effective in some cases. Hence, among the foregoing, dimethylsilicone oil, fluorine-modified silicone oils and fluorinated hydrocarbons are preferably used because of less reactivity and polarity, no strong adsorption and no compatibility with binder resins.

Any of these liquid lubricants may preferably be added in the external additive or made to be supported on the colorant or magnetic powder so as to be in an amount of from 0.1 to 7 parts by weight, and more preferably from 0.2 to 5 parts by weight, based on 100 parts by weight of the binder resin.

A release agent of various types may be added in the positively chargeable developer used in the present invention. Such a release agent may include polyfluoroethylene, fluorine resins, fluorocarbon oil, silicone oil, low-molecular weight polyethylene, low-molecular weight polypropylene and various types of waxes.

In the positively chargeable toner used in the present invention, a positive charge control agent may be incorporated as a material for making the toner chargeable to the positive polarity. The positive charge control agent used in such an instance may include, e.g., Nigrosine and modified products thereof, modified with a fatty acid metal salt; quaternary ammonium salts such as tributylbenzylammonium 1-hydroxy-4-naphthosulfonate, tetrabutylammonium tetrafluoroborate, and analogues of these, onium salts such as phosphonium salts, and lake pigments of these (a lake forming agent may include tungstophosphoric acid, molybdophosphoric acid, tungstomolybdophosphoric acid, tannic acid, lauric acid, gallic acid, ferricyanides and ferrocyanides); metal salts of higher fatty acid; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds; and imidazole compounds. Any of these may be used alone or in combination of two or more kinds. In the present invention, among these compounds, preferably usable are triphenylmethane compounds, imidazole compounds, and quaternary ammonium salt compounds whose counter ions are not halogens.

A homopolymer of a monomer represented by the following Formula (1) or a copolymer of a monomer represented by the following Formula (1) with the polymerizable monomer such as styrene, acrylate or methacrylate as described previously may also be used as the positive charge control agent. In this case, such a positive charge control agent also has the action as the binder resin for toner.

(1)

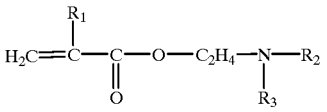

wherein $R_1$ is H or $CH_3$, and $R_2$ and $R_3$ are each a substituted or unsubstituted alkyl group (preferably having 1 to 4 carbon atoms).

To the positively chargeable toner used in the present invention, comprised of the constituent materials as described above, a fine powder may optionally be externally added for the purpose of improving fluidity. The fine powder used in such an instance may include inorganic fine powders of inorganic oxides such as silica, alumina, titania, germanium oxide and zirconium oxide; inorganic carbides such as silicon carbide and titanium carbide; and inorganic nitrides such as silicon nitride and germanium nitride.

These inorganic fine powders may be used after their organic treatment with an organosilicon compound or a titanium coupling agent. The organosilicon compound used in this case may include, e.g., silane coupling agents such as hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

Those obtained by treating an untreated fine powder with a silane coupling agent containing a nitrogen atom may also be used. This embodiment is particularly preferred in the case of the positively chargeable toner used in the present invention. As examples of such a treating agent, it may include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltrimethoxysilane, trimethoxysilyl-γ-propylphenylamine, trimethoxysilyl-γ-propylbenzylamine, trimethoxysilyl-γ-propylpiperidine, trimethoxysilyl-γ-propylmorpholine and trimethoxysilyl-γ-propylimidazole. These treating agents may be used alone or in the form of a mixture of two or more, or may be used in combination or after multiple treatment.

The inorganic fine powder may be treated with the above silane coupling agent by a method including, e.g., spraying, organic solvent treatment and aqueous solution treatment. The treatment by spraying is commonly a method in which a pigment (the inorganic fine powder) is agitated and an aqueous solution or solvent solution of the coupling agent is sprayed on the pigment being agitated, followed by drying at about 120 to 130° C. to remove the water or solvent. The organic solvent treatment is a method in which the coupling agent is dissolved in an organic solvent (e.g., alcohol, benzene, halogenated hydrocarbons) containing a hydrolysis catalyst together with a small quantity of water, and the pigment is immersed in the resultant solution, followed by filtration or pressing to effect solid-liquid separation and then drying at about 120 to 130° C. The aqueous solution treatment is a method in which about 0.5% of the coupling agent is hydrolyzed in water or in a water-solvent mixture with a stated pH and the pigment is immersed in the resultant hydrolyzate, similarly followed by solid-liquid separation and then drying.

As other organic treatment of the fine powder, the inorganic fine powder may be treated with a liquid lubricant. For example, a fine powder treated with silicone oil for the purpose of preventing filming and improving transfer performance may preferably be used. The silicone oil used as the liquid lubricant may commonly include those represented by the following formula (2), as those preferably used.

(2)

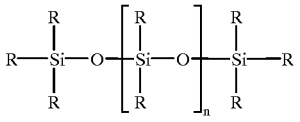

wherein R represents an alkyl group (e.g., a methyl group) or an aryl group, and n represents an integer.

As a preferred silicone oil usable in the present invention, a silicone oil having a viscosity at 25° C. of from about 0.5 to 10,000 $mm^2/s$, and preferably from 1 to 1,000 $mm^2/s$, may be used, which may include, e.g., methylhydrogensilicone oil, dimethylsilicone oil, phenylmethylsilicone oil, chlorophenylmethylsilicone oil, alkyl-modified silicone oil, fatty-acid-modified silicone oil, polyoxyalkylene-modified silicone oil and fluorine-modified silicone oil.

A silicone oil having a nitrogen atom on the side chain may be used. In the case of the positively chargeable toner used in the present invention, it is particularly preferable to use as the liquid lubricant of the inorganic fine powder the silicone oil having a nitrogen atom on the side chain. Such a silicone oil may include silicone oils having at least a unit structure represented by the following formula (3) or (4).

(3)

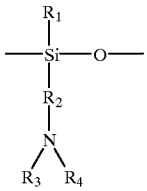

(4)

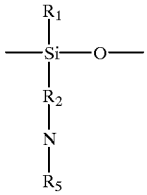

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic group.

In the above formula, the alkyl group, aryl group, alkylene group and phenylene group may each have an organo group having a nitrogen atom, or may have a substituent such as a halogen.

The treatment of the inorganic fine powder with the modified silicone oil having an amine as described above may be made, e.g., in the following way: The inorganic fine powder is kept agitated vigorously while optionally heating it, and the modified silicone oil having an amine or its solution is sprayed, or vaporized and then sprayed. Alternatively, the inorganic fine powder is made into a slurry, and the modified silicone oil having an amine or its solution is added dropwise to the slurry while stirring it, whereby the inorganic fine powder can be treated with ease.

Any of these silicone oils may be used alone or in the form of a mixture of two or more, or may be used in combination or after multiple treatment. The above treatment may be made in combination with the treatment with the silane coupling agent.

As the positively chargeable developer used in the present invention, in view of the advantages that development faithful to the electrostatic latent image can be made and developing performance with superior fine-line reproducibility and halftone gradation can be achieved, it is preferable to use those containing a toner having particle diameter and particle size distribution as shown below. That is, it is preferable to use those having been controlled to have, in particle size distribution of the toner, a weight-average particle diameter of from 3 to 12 μm, and more preferably from 5 to 10 μm, and in which toner particles with diameters of 4.0 μm or smaller are preferably in a content of 30% by number or less, and more preferably from 5 to 20% by number, and toner particles with diameters of 12.7 μm or larger preferably in a content of 12.0% by volume or less, and preferably 10.0% by volume or less.

If the toner has a weight-average particle diameter smaller than 3 μm, difficulties such as toner scatter and fog may occur, and, when used in the formation of graphic images or the like having a high image area percentage, problems tend to occur such that the toner may be laid on transfer paper in so small a quantity as to result in a low image density. If on the other hand the toner has a weight-average particle diameter larger than 12 μm, the reproducibility of minute dots may lower to provide no good resolution, or the toner may scatter at the time of transfer to tend to further cause a decrease in image quality as copying is continued, even if the quality is good at the beginning.

If the toner particles with diameters of 4 μm or smaller are in a content more than 30% by number, fog tends to occur, and also the toner particles tend to become aggregated one another to form toner lumps having diameters larger than the original ones, resulting in coarse images and a lowering of resolution, or resulting in a great difference in density between edges and inner areas of latent images to tend to cause somewhat hollow-character images.

If the toner particles with diameters of 12.7 μm or larger is in a content more than 12.0% by volume, toner scatter tends to occur to not only hinder the fine-line reproduction but also cause poor-transfer images. The latter is caused in the course of transfer, where a little coarse toner particles with diameter larger than 12.7 μm may become present protrudently from the surface of a thin layer of particles of toner images formed by development on the photosensitive member, to make irregular the state of delicate close contact between the photosensitive member and the recording paper through such a toner image layer to cause variations of transfer conditions.

In the present invention, the particle size distribution of the toner is measured in the following way.

The average particle diameter and particle size distribution of the toner may be measured with Coulter Counter TA-II or Coulter Multisizer II (manufactured by Coulter Electronics, Inc.). In the present invention, they are measured using Coulter Multisizer II (manufactured by Coulter Electronics, Inc.). An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used.

Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has thus been suspended is subjected to dispersion treatment for about 1 minute to about 3 minutes in an ultrasonic dispersion machine. The volume distribution and number distribution are calculated by measuring the volume and number of toner particles with particle diameters of 2 μm or larger by means of the above Coulter Multisizer, using an aperture of 100 μm as its aperture. Then the weight-based (the middle value of each channel is used as the representative value for each channel), weight average particle diameter (D4) is determined from volume distribution, the percent by number of toner particles with diameters of 4.0 μm or smaller is determined from number distribution and the percent by volume of toner particles with diameters of 12.7 μm or larger is determined from volume distribution.

In the case when images are formed using the positively chargeable developer containing the toner having a small particle diameter and a specific particle size distribution as stated above, the toner has a larger surface area per unit weight as previously stated, to come to have a large charge quantity per unit weight (mC/kg). Accordingly, the developer tends to cause sleeve ghost because of the phenomenon of charge-up especially in an environment of low temperature and low humidity.

In the present invention, however, a developer carrying member having the resin coat layer comprised of a specific resin composition described later is used as the developer carrying member used in the developing apparatus. Hence, good images can be formed even when images are formed using the positively chargeable developer containing the toner having a small particle diameter and a specific particle size distribution. More specifically, the phenomenon of charge-up which occurs in an environment of low temperature and low humidity when such a developer is used can be restrained because the resin coat layer formed on the developer carrying member, containing the conductive material, leaks charges of the toner appropriately. Also, when such a developer is used, a problem tends to occur in the rise of charging of the toner in an environment of high temperature and high humidity. However, the rise of charging of the toner can be made higher by the resin coat layer constituting the developer carrying member used in the present invention, formed using a resin composition containing the quaternary ammonium salt compound which is positively chargeable to iron powder and the specific binder resin, and having the negative chargeability sufficiently. Thus, even when the positively chargeable developer having the toner having a small particle diameter and a specific particle size distribution as stated above is used, it can be successfully well used in every environment of normal temperature/normal humidity as a matter of course, and also low temperature/low humidity and high temperature/high humidity.

In the present invention, a magnetic toner constituted as described above may be used as a one-component type developer. Also, a non-magnetic toner may be blended with a carrier so as to be used as a two-component type developer, or, without being blended with a carrier, may be used as a one-component type non-magnetic developer.

The developer carrying member in the present invention which carries the positively chargeable developer as described above will be described below in detail. Its operation will be described while showing in FIG. 4 an example of the developer carrying member used in the present invention.

Figure 4:
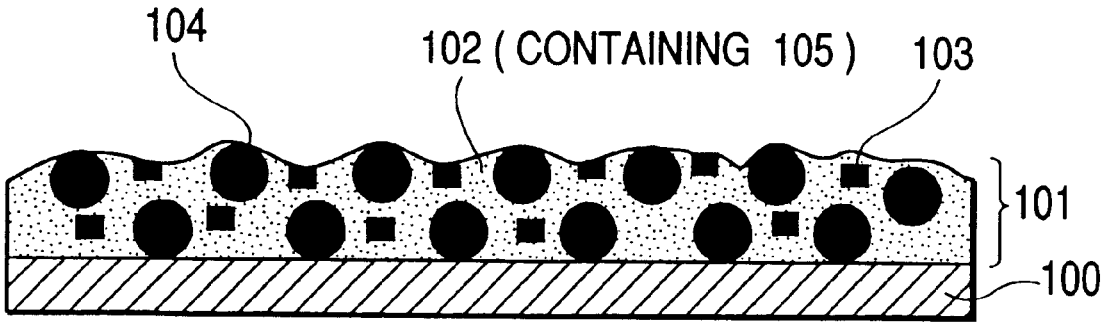
FIG. 4 is a diagrammatic view showing the resin coat layer on the surface of the developer carrying member.

In the first place, the developer carrying member used in the present invention has at least a substrate and the resin coat layer. As shown in FIG. 4, a resin coat layer 101 formed on a substrate 100 contains at least a binder resin 102, a conductive fine powder 103, spherical particles 104 having a number-average particle diameter of from 0.3 μm to 30 μm and a quaternary ammonium salt compound 105 which is positively chargeable to iron powder.

As described previously, among quaternary ammonium salt compounds as represented by Formula (5) shown below, the quaternary ammonium salt compound which is positively chargeable to iron powder is contained in the resin coat layer constituting the developer carrying member used in the present invention. Thus, the quaternary ammonium salt compound is incorporated in the molecular structure of the binder resin which is a film forming material, and the resin coat layer itself is made to be a substance readily negatively chargeable, so that its positive-charge-providing performance to the positively chargeable developer can be improved. In addition, the binder resin is formed, in part or entirely, using the binder resin having at least any of an —$NH_2$ group, an =NH group and an —NH— linkage. This makes it easier for the above specific quaternary ammonium salt compound to be incorporated in the molecular structure of the binder resin.

(5)

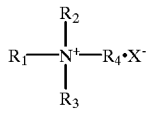

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

In the above general formula (5), as examples of the anion represented by $X^-$, it may include organic sulfate ions, organic sulfonate ions, organic phosphate ions, molybdate ions, tungstate ions, and heteropolyacid ions containing molybdenum atoms or tungsten atoms.

In addition, since the conductive fine powder is added to the resin coat layer constituting the developer carrying member used in the present invention, this makes electric charges not stagnate on the developer carrying member surface, and hence the toner can be kept from not being strongly attracted by the action of mirror force. Hence, this can restrain faulty coat which may cause blotches to make the toner stick or melt-adhere. In the resin coat layer, the spherical particles having a number-average particle diameter of from 0.3 $\mu$m to 30 $\mu$m are added. This can make stable the surface roughness of the developer carrying member, thus the coat quantity of the toner carried on the developer carrying member can be optimized. Also, in this instance, conductive spherical particles may especially be used, whereby the toner coat on the developer carrying member can be made more uniform, and hence the wear resistance and environmental stability of the developer carrying member can be more improved to make it possible to obtain good images even in the running over a long term. As the conductive spherical particles, it is more preferable to use those having a true density of 3 g/cm$^3$ or below.

As stated previously, the developer carrying member used in the present invention, provided with the resin coat layer constituted as described above may be used in combination with the positively chargeable toner to which the external additive treated with the liquid lubricant described above has externally been added, or the positively chargeable toner containing the colorant having the liquid lubricant supported thereon or the magnetic powder having the liquid lubricant supported thereon. This brings about the good effect stated above and materializes good charging of the positively chargeable toner.

The resin coat layer formed of the constituent materials described above may preferably have a surface roughness in the range from 0.2 to 3.5 $\mu$m, and more preferably in the range from 0.5 to 2.5 $\mu$m, as JIS arithmetic center-line surface roughness (Ra). If the resin coat layer has an Ra smaller than 0.2 $\mu$m, the toner on the developer carrying member may undesirably form an immobile layer on the surface of the developer carrying member because of mirror force. Once the immobile layer is formed, the toner may become so insufficiently charged as to result in an unsatisfactory developing performance, tending to cause faulty images such as uneven images, black spots around line images and density decrease. If it has an Ra larger than 3.5 $\mu$m, the toner coat layer may be so insufficiently regulated on the developer carrying member as to result in an unsatisfactory image uniformity, or the toner may be so insufficiently charged as to cause a density decrease.

In the present invention, the center-line surface roughness of the resin coat layer is measured using a surface roughness meter SE-3300H (manufactured by Kosaka Kenkyusho) and under conditions of a cut-off of 0.8 mm, a specified distance of 8.0 mm and a feed rate of 0.5 mm/sec, and measurements at 12 spots are averaged.

The resin coat layer constituted as described above may preferably have a layer thickness of 25 $\mu$m or less, more preferably 20 $\mu$m or less, and still more preferably from 4 to 20 $\mu$m. In such a thickness, a uniform layer thickness can be attained with ease. The layer thickness depends on the materials used in the resin coat layer, and can be attained when formed in a coating weight of from about 4,000 to 20,000 mg/m$^2$ as weight on the substrate.

Materials constituting the resin coat layer which is an essential constituent of the developer carrying member used in the present invention will be detailed below.

In the developer carrying member used in the present invention, the quaternary ammonium salt compound added to the resin coat layer may include any quaternary ammonium salt compounds so long as they are positively chargeable to iron powder. The quaternary ammonium salt compound, as being incorporated in the molecular structure of the specific binder resin, has the action to make the resin coat layer have an improved positive-charge-providing performance to the positively chargeable developer.

In the present invention, the charge polarity of quaternary ammonium salt compound to iron powder is measured in the following way.

Figure 9:
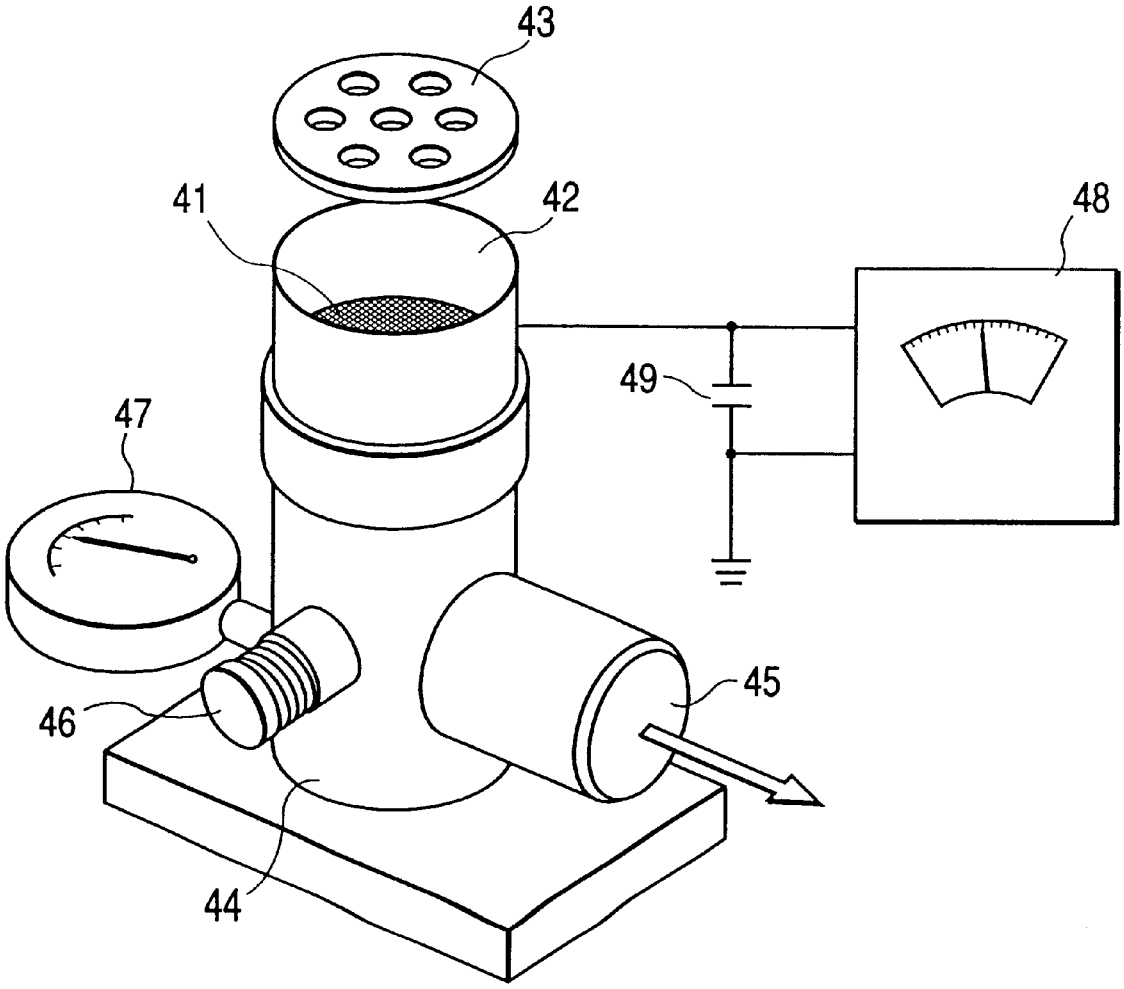
FIG. 9 illustrates a triboelectric charge quantity measuring device used to measure the charge polarity of quaternary ammonium salt compounds to iron powder.

Polarity of triboelectricity to iron powder is measured by the blow-off process, using a commercially available triboelectric charge quantity measuring device (Model TB-200, manufactured by Toshiba Chemical Corporation), which is as shown in FIG. 9.

First, in an environment of 23° C. and relative humidity 60% and using EFV200/300 (available from Powder Teck Co.) as a carrier (iron powder), a mixture prepared by mixing 0.5 g of a quaternary ammonium salt compound in 9.5 g of the carrier is put in a bottle with a volume of 50 to 100 ml, made of polyethylene, and manually shaked 50 times. Then, 1.0 to 1.2 g of the resultant mixture is put in a measuring container 42 made of a metal at the bottom of which a conductive screen 43 of 500 meshes is provided, and the container is covered with a plate 43 made of a metal. Next, in a suction device 44 (made of an insulating material at least at the part coming into contact with the measuring container 42), air is sucked from a suction opening 45 and an air-flow control valve 46 is operated to control the pressure indicated by a vacuum indicator 47, so as to be 250 mm Aq. In this state, suction is carried out for 1 minute to remove the quaternary ammonium salt compound by suction. Polarity of the potential indicated by a potentiometer 48 at this time is read, and is used as the charge polarity of the quaternary ammonium salt compound to iron powder. Reference numeral 49 denotes a capacitor.

In the present invention, the charge polarity of resin coat layer (resin component only) to iron powder is measured in the following way.

Preparation of Sample Plate:

A solution of a resin for forming the resin coat layer whose charge polarity is to be measured (except the conductive material such as carbon or graphite) is coated on a SUS stainless steel plate by means of a bar coater (#60), the wet coating thus formed is dried or heated to form a film (drying or heating temperature and time are those of until the solution evaporates completely in the case of a thermoplastic resin, and until the resin is completely cross-linked in the case of a thermosetting resin) to prepare a sample plate. This sample plate is left overnight in an environment of 23° C. and 60% RH in the state it is grounded.

Figure 10:
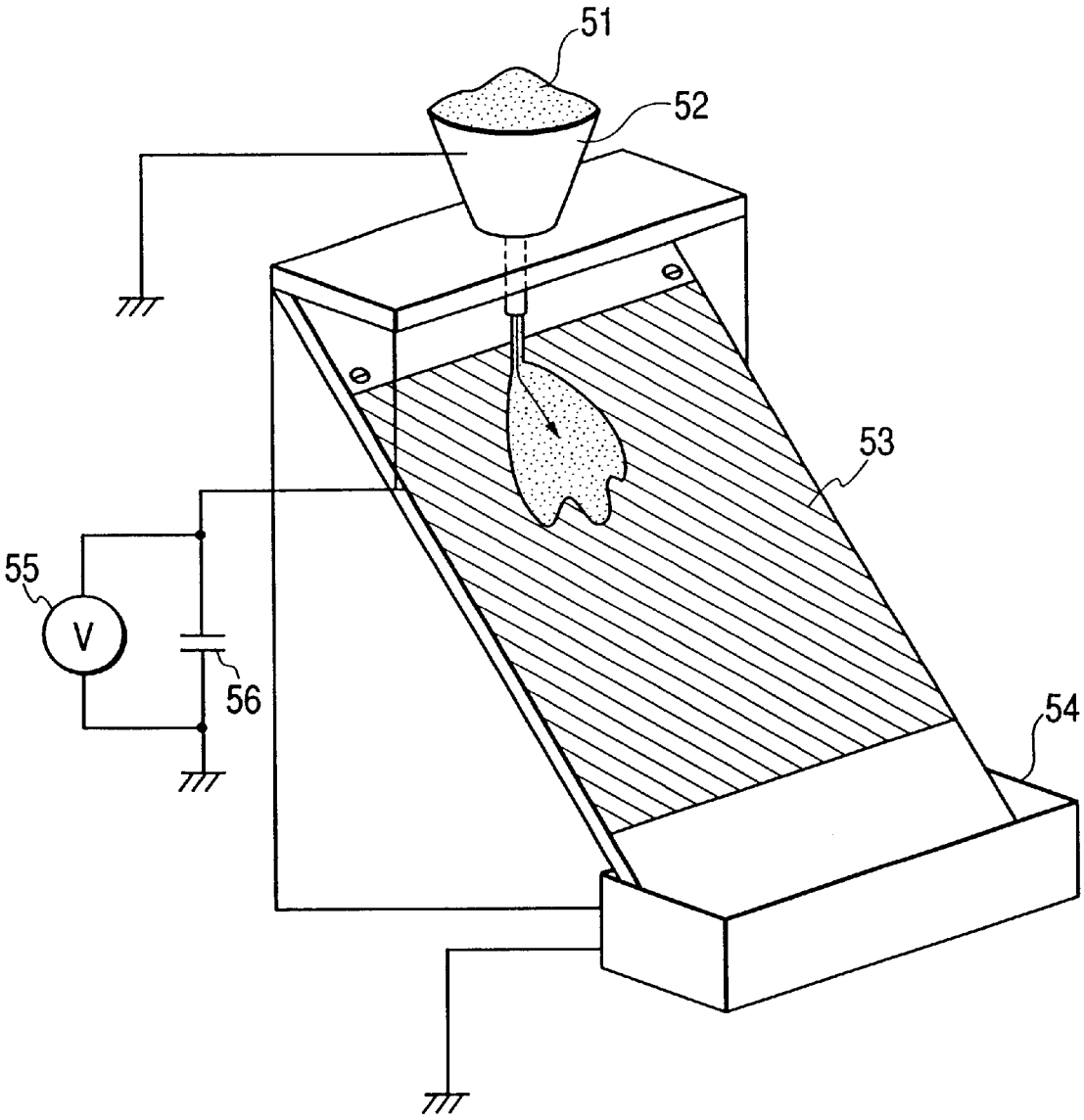
FIG. 10 illustrates a surface charge quantity measuring device for measuring the charge polarity of resin coat layers.

Preparation of Positive Toner Model Particles:

To 100 parts by weight of a styrene/2-ethylhexyl acrylate/divinylbenzene copolymer (copolymerization ratio: 80/17.5/2.5; weight-average molecular weight Mw: 320,000), 10 parts by weight of a toluene fluid in which 2 parts by weight of KOPIE BLUE PR (available from Clariant GmbH) (solid matter concentration: 10% by weight) and 100 parts by weight of spherical ferrite particles (particle diameter: about 90 $\mu$m) are added, which are then agitated at 80° C. for 4 hours by means of a Nauta mixer. The resultant mixture is heated at 140° C. for 1 hour to make the solvent volatilize completely, thus resin layers are formed on the ferrite particle surfaces. The resultant particles are disintegrated while cooling them to room temperature, followed by sieving with a 83-mesh sieve to remove blocked particles. The resultant particles are left overnight or longer in an environment of 23° C. and 60% RH in the state they are grounded. These are designated as positive toner model particles 51 (FIG. 10).

Measurement:

The charge polarity is measured in an environment of 23° C. and 60% RH. First, the sample plate prepared as described above is set on a surface charge quantity measuring device TS-100AS (manufactured by Toshiba Chemical Co., Ltd.), which is as shown in FIG. 10, and a potentiometer 55 is grounded to make its value 0. The positive toner model particles 51 prepared as described above are put in a dropping container 52. A START switch is pushed to drop the positive toner model particles 51 on the sample plate 53 for 20 seconds, and are received in a receiving container 54 grounded beforehand. The polarity indicated at this time by the potentiometer 55 is read, and is used as the charge polarity of resin coat layer (resin component only) to iron powder. Reference numeral 56 denotes a capacitor.

Among the above quaternary ammonium salt compounds represented by Formula (5), the quaternary ammonium salt compound which is positively chargeable for itself to iron powder, preferably used in the present invention, may specifically include the following. Of course, the present invention is by no means limited to these.

Exemplary Compound 1

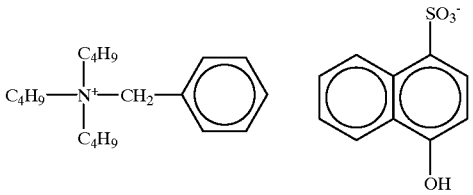

-continued

Exemplary Compound 2

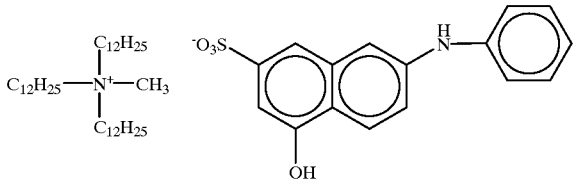

Exemplary Compound 3

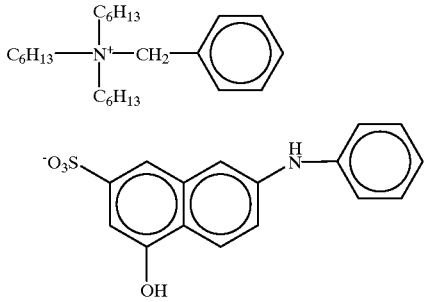

Exemplary Compound 4

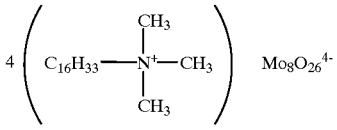

Exemplary Compound 5

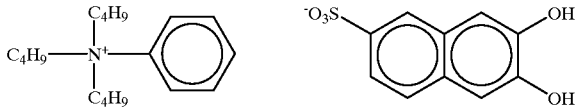

Exemplary Compound 6

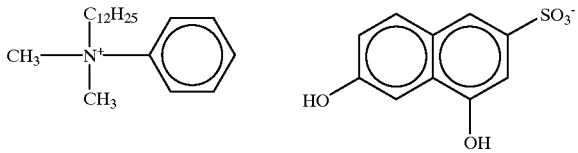

Exemplary Compound 7

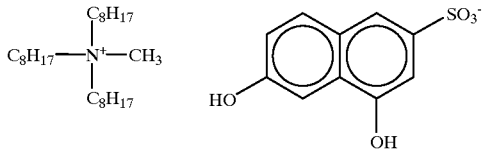

Exemplary Compound 8

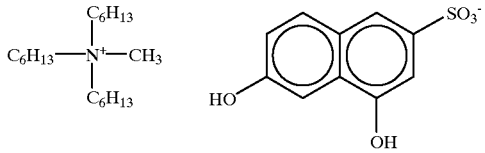

As the quaternary ammonium salt compound which is positively chargeable to iron powder, used in the present invention, the quaternary ammonium salt compounds shown above as Exemplary Compounds 1 to 8 may preferably be used, but are by no means limited to these so long as the compound is positively chargeable to iron powder. Meanwhile, fluorine-containing quaternary ammonium salt compounds like a compound shown below as Exemplary Compound 9, having in the molecular structure the strongly electron-withdrawing fluorine atom, are negatively chargeable to iron powder. According to studies made by the present inventors, however, these can not well charge the positively chargeable toner.

Exemplary Compound 9

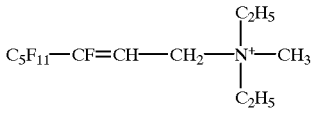

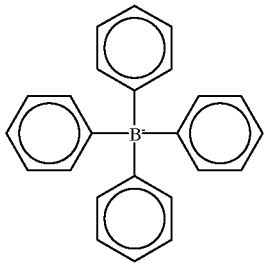

In the developer carrying member used in the present invention, the binder resin acting as a film-forming material when the resin coat layer is formed on the developer carrying member may be of any types, and may preferably be those having the structure of any of an —$NH_2$ group, an ═NH group and an —NH— linkage. Materials having the —$NH_2$ group may include, e.g., primary amines represented by R—$NH_2$ or polyamines having such amines, and primary amides represented by RCO—$NH_2$ or polyamides having such amides. Materials having the ═NH group may include, e.g., secondary amines represented by R═NH or polyamines having such amines, and secondary amides represented by $(RCO)_2$═NH or polyamides having such amides. Materials having the —NH— linkage may include, e.g., in addition to the above polyamines and polyamides, polyurethanes having an —NHCOO— linkage.

In the present invention, industrially synthesized resins containing one or more of the above materials or containing them as a copolymer may preferably be used. In the present invention, among these, it is particularly preferable to use a phenol resin produced in the presence of ammonia as a catalyst, a polyamide resin and a urethane resin, as used in Examples.

The reason is unclear why in the present invention the resin coat layer can be a good charge-providing material for developers having positively chargeable toners, when the resin composition used to form a resin coat layer on the developer carrying member is constituted as described above. The present inventors presume it as follows:

When the quaternary ammonium salt compound used in the present invention, which is positively chargeable for itself to iron powder, is added in phenol resin, it is uniformly dispersed in the phenol resin, and is further incorporated into the structure of the phenol resin in the course the resin is heated to harden to form the resin coat layer, so that such a phenol resin composition itself containing the above compound changes into a material having negative chargeability.

When the quaternary ammonium salt compound used in the present invention, which is positively chargeable for itself to iron powder, is added in polyamide resin, it is uniformly dispersed in the polyamide resin, and is further incorporated into the structure of the polyamide resin in the course the resin is heated and dried to form the resin coat layer, so that such a polyamide resin composition itself containing the above compound comes to be readily chargeable to the polarity opposite to the positively chargeable developer.

When the quaternary ammonium salt compound used in the present invention, which is positively chargeable for itself to iron powder, is used in a urethane resin coat layer and is added in urethane resin, it is first uniformly dispersed in the urethane resin, and is further readily incorporated into the structure of the urethane resin in the course the resin is heated to harden to form the resin coat layer. In that course, the original structure of the quaternary ammonium salt compound having a positive polarity is lost, and the urethane resin incorporated with the quaternary ammonium salt compound comes to have a uniform and sufficient negative chargeability, so that such a urethane resin composition itself containing the above compound comes to be readily chargeable to a polarity opposite to the positively chargeable developer.

The quaternary ammonium salt compound which is positively chargeable to iron powder, used in the present invention, may preferably be added in an amount of from 1 part by weight to 100 parts by weight based on 100 parts by weight of the binder resin. In an amount less than 1 part by weight, its addition may bring about no improvement in charge-providing performance. If added in an amount more than 100 parts by weight, the compound may be poorly dispersed in the binder resin, tending to cause a decrease in film strength.

As a result of extensive studies made by the present inventors, it has also been found that, as the phenol resin used in the present invention, a phenol resin produced in the presence of a nitrogen-containing compound as a catalyst in its production process may preferably be used especially because the quaternary ammonium salt compound can readily be incorporated into the structure of the phenol resin at the time of heating and hardening. Accordingly, in the present invention, such a phenol resin produced in the presence of a nitrogen-containing compound as a catalyst in its production process, having such action, may be used as one of materials constituting the resin coat layer formed on the developer carrying member, whereby a developing apparatus having a good positive charge-providing performance can be materialized.

The nitrogen-containing compound used as a catalyst in the production process for the phenol resin, which is preferably usable in the present invention may include, e.g., as acidic catalysts, ammonium salts such as ammonium sulfate, ammonium phosphate, ammonium sulfaminate, ammonium carbonate, ammonium acetate and ammonium maleate, or amine salts; as basic catalysts, ammonia, and amino compounds such as dimethylamine, diethylamine, diisopropylamine, diisobutylamine, diamylamine, trimethylamine, triethylamine, tri-n-butylamine, triamylamine, dimethylbenzylamine, diethylbenzylamine, dimethylaniline, diethylaniline, N,N-di-n-butylaniline, N,N-diamylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine; and nitrogen-containing heterocyclic compounds. The nitrogen-containing heterocyclic compounds may include pyridine and derivatives thereof such as α-picoline, β-picoline, γ-picoline, 2,4-lutidine and 2,6-lutidine; quinoline compounds; and imidazole and derivatives thereof such as 2-methylimidazole, 2,4-dimethylimidazole, 2-ethyl-4-methylimidazole, 2-phenylimidazole, 2-phenyl-4-methylimidazole and 2-heptadecylimidazole.

The polyamide resin used in the present invention may include, e.g., nylons such as nylon 6, nylon 66, nylon 610, nylon 11, nylon 12, nylon 9, nylon 13, and nylon Q2, and copolymer nylons composed chiefly of any of these, N-alkyl-modified nylons, and N-alkoxyalkyl-modified nylons, any of which may preferably be used. It may also include various resins modified with polyamide, such as polyamide-modified phenol resins, and resins containing a polyamide resin component, such as epoxy resins making use of a polyamide resin as a curing agent, any of which may also preferably be used. In the present invention, the above nylons and copolymer nylons composed chiefly of any of them may particularly preferably be used.

As the urethane resin used in the present invention, any urethane resins may preferably be used so long as they are resins containing a urethane linkage. The urethane linkage can be obtained by polyaddition reaction of a polyisocyanate with a polyol.

The polyisocyanate, a chief material of the urethane resin, may include aromatic polyisocyanates such as TDI (tolylene diisocyanate), pure MDI (diphenylmethane diisocyanate), polymeric MDI (polymethylene polyphenyl polyisocyanate), TODI (tolidine diisocyanate) and NDI (naphthalene diisocyanate); and aliphatic polyisocyanates such as HMDI (hexamethylene diisocyanate), IPDI (isophorone diisocyanate), XDI (xylylene diisocyanate), hydrogenated XDI (hydrogenated xylilene diisocyanate) and hydrogenated MDI (dicyclohexylmethane diisocyanate).

The polyol which reacts with the above polyisocyanate may include polyether polyols such as PPG (polyoxypropylene glycol), polymer polyol and polytetramethylene glycol (PTMG); polyester polyols such as adipate, polycaprolactone and polycarbonate polyol; polyether type modified polyols such as PHD polyol and polyether ester polyol; epoxy-modified polyols; partially saponified polyols of ethylene-vinyl acetate copolymer (saponified EVA); and flame-retardant polyols.

The spherical particles having a number-average particle diameter of from 0.3 $\mu$m to 30 $\mu$m, contained in the resin coat layer, will be described below. The incorporation of the spherical particles into the resin coat layer brings about advantages that the surface of the resin coat layer can be made to have a uniform surface roughness and at the same time the surface roughness of the resin coat layer can be made to less change even if the resin coat layer surface has worn and also the contamination by toner or melt-adhesion of toner can be made to hardly occur. The incorporation of the spherical particles also brings about advantages that the effect of rapid and uniform charge-providing action and charge control to the positively chargeable developer can be more improved by virtue of mutual action and also the charging performance can be made stable; the effect being achieved by the binder resin contained in the resin coat layer, especially by the specific binder resin having the structure of any of an —$NH_2$ group, an =NH group and an —NH— linkage as described above, and by the quaternary ammonium salt compound.

The spherical particles used in the present invention, which can be well effective as stated above, may have a number average particle diameter of from 0.3 to 30 $\mu$m, and preferably from 2 to 20 $\mu$m. If the spherical particles have a number average particle diameter smaller than 0.3 $\mu$m, the uniform surface roughness can be less effectively imparted to the surface of the resin coat layer, the charging performance can be less effectively improved, the rapid and uniform charging to the developer may be insufficient and also the charge-up of toner, contamination by toner and melt-adhesion of toner may occur as a result of the wear of the resin coat layer to tend to cause a serious ghost and a decrease in image density. If the spherical particles have a number average particle diameter larger than 30 $\mu$m, the resin coat layer may have an excessively rough surface to make it difficult for the toner to be well charged and also cause a decrease in mechanical strength of the resin coat layer.

In the developer carrying member in the present invention, the spherical particles may preferably have a true density of 3 g/cm$^3$ or below, more preferably 2.7 g/cm$^3$ or below, still more preferably from 0.9 to 2.7 g/cm$^3$ and most preferably from 0.9 to 2.5 g/cm$^3$. If the spherical particles have a true density exceeding 3 g/cm$^3$, the dispersibility of the spherical particles in the resin coat layer tends to be insufficient to make it difficult to impart a uniform roughness to the surface of the resin coat layer, tending to result in an insufficient uniform charging performance of the toner and an insufficient strength of the resin coat layer. In instances where the spherical particles have a too small true density, too, the spherical particles tends to be insufficiently dispersed in the resin coat layer.

In the present invention, the true density of the spherical particles is measured with a dry densitometer ACUPIC (manufactured by Shimadzu Corporation).

The "spherical" in the spherical particles used in the present invention is not limited to the truely spherical, and refers to particles having a length/breadth ratio of from 1.0 to 1.5. In the present invention, it is more preferable to use spherical particles having a length/breadth ratio of from 1.0 to 1.2, and is most preferable to use truely spherical particles. Spherical particles having a length/breadth ratio larger than 1.5 are not preferable in view of uniform charging of the toner and strength of the resin coat layer, because the dispersibility of the spherical particles in the resin coat layer may lower and also the surface roughness of the resin coat layer may be non-uniform.

In the present invention, to measure the length/breadth ratio of the spherical particles, an enlarged photograph taken at magnifications of 6,000 times using an electron microscope is used, and, on one hundred particles sampled from this enlarged photograph at random, their length and breadth are measured to determine length/breadth ratios. Their average value is regarded as the length/breadth ratio.

As the spherical particles used in the present invention, any conventionally known spherical particles may be used so long as they have a number-average particle diameter of from 0.3 $\mu$m to 30 $\mu$m, including, e.g., spherical resin particles, spherical metal oxide particles and spherical carbide particles. In particular, spherical resin particles are preferred because a preferable surface roughness can be achieved by their addition in a smaller quantity when added to the resin coat layer and also a uniform surface shape can be attained with ease. The spherical resin particles usable in the present invention can readily be obtained by, e.g., suspension polymerization or dispersion polymerization. Of course, resin particles obtained by pulverization made into spherical particles by thermal or physical sphering treatment may also be used.

Spherical resin particles preferred in the present invention may specifically include, e.g., particles of acrylic resins such as polyacrylate and polymethacrylate; particles of polyamide resins such as nylon; particles of polyolefin resins such as polyethylene and polypropylene; particles of silicone resins; particles of phenol resins; particles of polyurethane resins, particles of styrene resins; and benzoguanamine particles.

The spherical resin particles used in the present invention may be made to have an inorganic fine powder deposited or fixed on their surfaces. For example, the surface treatment of spherical resin particles with such an inorganic fine powder as shown below enables improvement in the dispersibility of spherical particles in the resin coat layer, and improvements in the surface uniformity of the resin coat layer formed, the stain resistance of the resin coat layer, the charge-providing performance to toner and the wear resistance of the resin coat layer.

The inorganic fine powder used here may include oxides such as $SiO_2$, $SrTiO_3$, $CeO_2$, CrO, $Al_2O_3$, ZnO and MgO; nitrides such as $Si_3N_4$; carbides such as SiC; and sulfates or carbonates such as $CaSO_4$, $BaSO_4$ and $CaCO_3$. These inorganic fine powders may be treated with a coupling agent. More specifically, especially for the purpose of improving their adhesion to the binder resin or for the purpose of imparting hydrophobicity to the particles, the inorganic fine powder treated with a coupling agent may preferably be used.

The coupling agent used here may include, e.g., silane coupling agents, titanium coupling agents and zircoaluminate coupling agents. Stated more specifically, e.g., the silane coupling agents may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenylethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

In the present invention, conductive spherical particles may also preferably be used as the spherical particles described above. More preferably, conductive spherical particles having a true density of 3 g/cm$^3$ or below may be used. That is, spherical particles endowed with electrical conductivity can make it hard for electric charges to accumulate on particle surfaces because of their electrical conductivity. Hence, in the developer carrying member according to the present invention, the incorporation of such conductive spherical particles in the resin coat layer can make the toner less adhere thereto and can restrain occurrence of toner contamination and toner melt-adhesion, also promising a superior charge-providing performance to the toner.

The "conductive" of the conductive spherical particles used in the present invention refers to having a volume resistivity of $10^6$ Ω·cm or below. In the present invention, it is preferable to use conductive spherical particles having a volume resistivity of from $10^3$ Ω·cm to $10^{-6}$ Ω·cm. If the spherical particles have a volume resistivity higher than $10^6$ Ω·cm, spherical particles laid bare to the surface of the resin coat layer as a result of wear may serve as nuclei around which toner contamination and melt-adhesion tend to occur and also it may be difficult to achieve rapid and uniform charging.

The volume resistivity of the conductive spherical particles is measured in the following way: Sample particles for measurement are put in an aluminum ring of 40 mm diameter, and press-molded under 2,500 N to measure the volume resistivity of the molded product by means of a resistivity meter LOW-RESTAR AP or HI-RESTAR IP (both manufactured by Mitsubishi Petrochemical Engineering Co., Ltd.), using a four-terminal probe. The measurement is made in an environment of temperature of 20 to 25° C. and humidity of 50 to 60% RH.

The conductive spherical particles used in the present invention and having the properties as described above may preferably be obtained by a method including the methods as described below, to which, however, the method is not necessarily limited.

As a method for obtaining conductive spherical particles particularly preferred in the present invention, it may include, e.g., a method in which spherical resin particles or mesocarbon microbeads are fired and thereby carbonized and/or graphitized to obtain spherical carbon particles having a low density and a good conductivity. Resin used here in the spherical resin particles may include, e.g., phenol resins, naphthalene resins, furan resins, xylene resins, divinylbenzene polymers, styrene-divinylbenzene copolymers, and polyacrylonitrile.

The mesocarbon microbeads can be usually produced by subjecting spherical crystals formed in the course of heating and firing a mesopitch, to washing with a large quantity of solvent such as tar, middle oil or quinoline.

As a method for obtaining more preferable conductive spherical particles, it may include a method in which a bulk-mesophase pitch is coated on the surfaces of spherical particles comprised of phenol resin, naphthalene resin, furan resin, xylene resin, divinylbenzene polymer, styrene-divinylbenzene copolymer or polyacrylonitrile by a mechanochemical method, and thereafter the particles thus coated are heated in an oxidizing atmosphere, followed by firing in an inert atmosphere or in vacuo so as to be carbonized and/or graphitized to obtain conductive spherical carbon particles. Spherical carbon particles obtained by this method are more preferred because the spherical carbon particles obtained when converted into graphite particles can be more crystallized at their coated portions to bring about an improvement in conductivity.

For the conductive spherical carbon particles obtained by the above various methods, even obtained by any of the methods, the electrical conductivity of the resulting spherical carbon particles can be controlled to a certain extent by changing conditions for firing, and such particles may preferably be used in the present invention. In order to more improve the electrical conductivity, the spherical carbon particles obtained by the above methods may optionally be coated with conductive metal and/or metal oxide to such an extent that the true density of the conductive spherical particles does not exceed 3 g/cm$^3$.

As another method for obtaining the conductive spherical particles preferably usable in the present invention, it may include the following method.

First, core particles comprised of spherical resin particles are prepared. Next, conductive fine particles having smaller particle diameters than the core particles obtained are mechanically mixed in a suitable mixing ratio to cause the conductive fine particles to uniformly adhere to the peripheries of the core particles by the action of van der Waals force and electrostatic force. Then, the surfaces of the core particles are softened by local temperature rise caused by, e.g., imparting mechanical impact to the core particles obtained as above to which the conductive spherical particles have adhered, thus the core particle surfaces are coated with the conductive fine particles, to obtain conductive-treated spherical resin particles.

As the core particles, it is preferable to use spherical resin particles comprised of an organic compound and having a small true density. The resin used here may include, e.g., PMMA, acrylic resins, polybutadiene resin, polystyrene resin, polyethylene, polypropylene, polybutadiene, or copolymers of any of these, benzoguanamine resin, phenol resins, polyamide resins, nylons, fluorine resins, silicone resins, epoxy resins and polyester resins. As the conductive fine particles (coat particles) used when they are caused to adhere to the surfaces of the core particles (base particles), it is preferable to use coat particles having an average particle diameter of ⅛ or less of the average particle diameter of the base particles so that the core particle surfaces can be uniformly provided with the conductive fine particles.

As still another method for obtaining the conductive spherical particles preferably usable in the present invention, it may include a method in which the conductive fine particles are uniformly dispersed in spherical resin particles to thereby obtain conductive spherical particles having the conductive fine particles dispersed therein. As a method for uniformly dispersing the conductive fine particles in the spherical resin particles, it may include, e.g., a method in which a binder resin and the conductive fine particles are kneaded to disperse the conductive fine particles in the binder resin, and thereafter the product is cooled to solidify and then pulverized into particles having a given particle diameter, followed by mechanical treatment and thermal treatment to make the particles spherical; and a method in which a polymerization initiator, the conductive fine particles and other additives are added in polymerizable monomers and uniformly dispersed therein by means of a dispersion machine to obtain a monomer composition, followed by suspension polymerization in an aqueous phase containing a dispersion stabilizer, by means of a stirrer so as to provide a given particle diameter, to obtain spherical particles having conductive fine particles dispersed therein.

The conductive spherical particles having the conductive fine particles dispersed therein, obtained by the above methods may be further mechanically mixed with conductive fine particles having smaller particle diameters than the core particles, in a suitable mixing ratio to cause the conductive fine particles to uniformly adhere to the peripheries of the spherical resin particles by the action of van der Waals force and electrostatic force, and thereafter the surfaces of the conductive spherical particles are softened by local temperature rise caused by, e.g., imparting mechanical impact so that the surfaces can be coated with the conductive fine particles, to obtain spherical resin particles made to have a higher conductivity.

In the present invention, the number-average particle diameter of the spherical particles is measured using a laser-diffraction particle size distribution analyzer LS-130 (manufactured by Coulter Co.) to which a liquid module is attached to measure number distribution, from which the number-average particle diameter is calculated.

The spherical particles used in the present invention may be contained in an amount of from 2 to 20 parts by weight, and more preferably from 2 to 80 parts by weight, based on 100 parts by weight of the binder resin. If the spherical particles of the resin coat layer are in a content less than 2 parts by weight, the addition of the spherical particles may be less effective. If they are in a content more than 120 parts by weight, it may be difficult to control the surface roughness within the proper range, and the resin coat layer may have so large a surface roughness as to make the developer layer on the developer carrying member non-uniform. Also, since the developer is carried thereon in a large quantity, it may become impossible to impart sufficient triboelectric charges to the developer. Still also, the resin coat layer may have a low film strength.

In the developer carrying member in the present invention, the resin coat layer formed by the constituent materials described above may also preferably be electrically conductive in order to prevent the developer from sticking onto the developer carrying member as a result of the charge-up or to prevent electric charges from being poorly imparted from the surface of the developer carrying member to the developer as being caused concurrently with the charge-up of the developer. Accordingly, in the present invention, the conductive fine powder is incorporated in the resin coat layer. In particular, the resin coat layer formed on the surface of the developer carrying member may preferably be so made as to have a volume resistivity of $10^3$ Ω·cm or below, more preferably from $10^{-2}$ to $10^3$ Ω·cm and more preferably from $10^{-2}$ to $10^2$ Ω·cm. If the resin coat layer has a volume resistivity higher than $10^3$ Ω·cm, electric charges tend to be poorly imparted to the developer, so that blotchy images tend to occur. If the resin coat layer has a too small volume resistivity, electric charges imparted to the developer may be too low to obtain a sufficient quantity of triboelectricity, tending to cause a decrease in image density.

In order to control the volume resistivity of the resin coat layer within the above range, a conductive fine powder shown below may preferably be added in the resin coat layer. The conductive fine powder may include, e.g., powders of metals such as copper, nickel, silver and aluminum or alloys thereof, metal oxides such as antimony oxide, indium oxide, tin oxide and titanium oxide, and carbonaceous conductive fine powders such as carbon fiber, carbon black and graphite. The amount of the conductive fine powder added may differ depending on the development system used. For example, when a one-component type insulating developer is used in jumping development, the conductive fine powder may be so added that the resin coat layer may have the volume resistivity of $10^3$ Ω·cm or below. Such a conductive fine powder may be in a content ranging from 1 to 100 parts by weight based on 100 parts by weight of the binder resin.

If the conductive fine powder is in a content less than 1 part by weight, the resin coat layer can not be made well conductive. If it is in a content more than 100 parts by weight the resin coat layer may have a low film strength and also the toner may have a low charge quantity. Thus, such content is not preferable.

As the conductive fine powder used in the present invention, carbon black may preferably be used. In particular, conductive amorphous carbon may preferably be used because it has especially a superior electrical conductivity, can impart conductivity by its addition in a small quantity and can attain a desired conductivity to a certain extent by controlling its quantity.

In the present invention, the volume resistivity of the resin coat layer is measured in the following way: A conductive coat layer of 7 to 20 μm thick is formed on a PET sheet of 100 μm thick, and its resistivity is measured using a voltage drop type digital ohmmeter (manufactured by Kawaguchi Denki Seisakusho), which is in conformity with the ASTM standard (D-991-82) and the Japan Rubber Association standard SRIS (2301-1969), used for measuring volume resistivity of conductive rubbers and plastics, and provided with an electrode of a four-terminal structure. The measurement is made in an environment of 20 to 25° C. and 50 to 60% RH.

It is also preferable to incorporate a solid lubricant in the resin coat layer constituting the developer carrying member used in the present invention. Such a solid lubricant may include, e.g., molybdenum disulfide, boron nitride, mica, graphite, graphite fluoride, silver-niobium selenide, calcium chloride-graphite, talc, Teflon, fluoropolymers such as PVDF, and fatty acid metal salts such as zinc stearate, magnesium stearate, aluminum stearate and zinc palmitate. In particular, graphite is preferably used because it has lubricity and also conductivity.

Any of these solid lubricants may preferably be contained in an amount ranging from 1 to 100 parts by weight based on 100 parts by weight of the binder resin. If the solid lubricant is in a content less than 1 part by weight, the object of adding the solid lubricant can not be well achieved, and the developer may adhere to the surface of the developer carrying member to tend to cause image deterioration. If it is in a content more than 100 parts by weight, the resin coat layer may have a low strength on the surface of the developer carrying member to tend to separate from the surface of the developer carrying member.

A developing apparatus of the present invention in which the developer carrying member according to the present invention, constituted as described above, has been incorporated will be described below as an example.

As shown in FIG. 1, an electrostatic latent image bearing member, e.g., an electrophotographic photosensitive drum 1, which bears an electrostatic latent image formed by a known process is rotated in the direction of an arrow B. A developing sleeve 8 as the developer carrying member is constituted of a cylindrical pipe (substrate) 6 made of metal, and a resin coat layer 7 formed on its surface. Inside a hopper 3 shown in FIG. 1, an agitating blade 10 for agitating a magnetic toner 4 is provided. The developing sleeve 8 carries the magnetic toner 4 as a one-component type magnetic developer fed by the hopper 3, and is rotated in the direction of an arrow A. Thus, the magnetic toner 4 is transported to a developing zone where the developing sleeve 8 and the photosensitive drum 1 face each other. Inside the developing sleeve 8, a magnet roller 5 is provided. The magnetic toner 4 gains triboelectric charges enabling the development of the electrostatic latent image on the photosensitive drum 1, as a result of its friction with the resin coat layer 7 on the developing sleeve 8.

In order to regulate the layer thickness of the magnetic toner 4 transported to the developing zone, a developer layer-thickness regulating member (regulating blade) 2 made of a ferromagnetic metal extends downwards vertically from the developer container, hopper 3 in such a manner that it faces on the developing sleeve 8, leaving a gap of about 200 to 300 $\mu$m wide between them. Thus, the magnetic line of force exerted from a magnetic pole N1 of the magnet roller 5 is converged to the blade 2 to thereby form on the developing sleeve 8 a thin layer of the magnetic toner 4. A knife-edge blade more strengthened in regulation force or a nonmagnetic blade may also be used in place of the blade 2.

The thickness of the thin layer of the magnetic toner 4, thus formed on the developing sleeve 8, may preferably be smaller than the minimum gap D between the developing sleeve 8 and the photosensitive drum 1 at the developing zone. The developer carrying member in the present invention is especially effective in the developing apparatus of the type the electrostatic latent image is developed through such a toner thin layer, i.e., a noncontact type developing apparatus. However, the developer carrying member in the present invention may also be applied in a developing apparatus of the type the thickness of the developer layer is larger than the minimum gap D between the developing sleeve 8 and the photosensitive drum 1 at the developing zone, i.e., a contact type developing apparatus. To avoid complicacy of description, the non-contact developing apparatus is taken as an example in the following description.

In the developing sleeve 8, in order to cause to fly the magnetic toner 4 which is the one-component type magnetic developer carried thereon, a development bias voltage is applied thereto through a power source 9. When a DC voltage is used as the development bias voltage, a voltage having a value intermediate between the potential at electrostatic latent image areas (the region rendered visible upon attraction of the magnetic toner 4) and the potential at back ground areas may preferably be applied to the developing sleeve 8. Meanwhile, in order to enhance the density of developed images or improve the gradation thereof, an alternating bias voltage may be applied to the developing sleeve 8 to form in the developing zone a vibrating electric field whose direction alternately reverses. In such a case, an alternating bias voltage formed by superimposing the above DC voltage component having a value intermediate between the potential at image areas and the potential at back ground areas may preferably be applied to the developing sleeve 8.

In the case of what is called regular development, where a toner is attracted to high-potential areas of an electrostatic latent image having high-potential areas and low-potential areas, a toner chargeable to a polarity reverse to the polarity of the electrostatic latent image may be used. On the other hand, in the case of what is called reverse development, where a toner is attracted to low-potential areas of the electrostatic latent image, a toner chargeable to the same polarity as the polarity of the electrostatic latent image may be used. Incidentally, what is meant by the high potential or the low potential is expressed by the absolute value. In either case, the magnetic toner 4 is electrostatically charged to the polarity for developing the electrostatic latent image, upon its friction with the developing sleeve 8.

Figure 2:
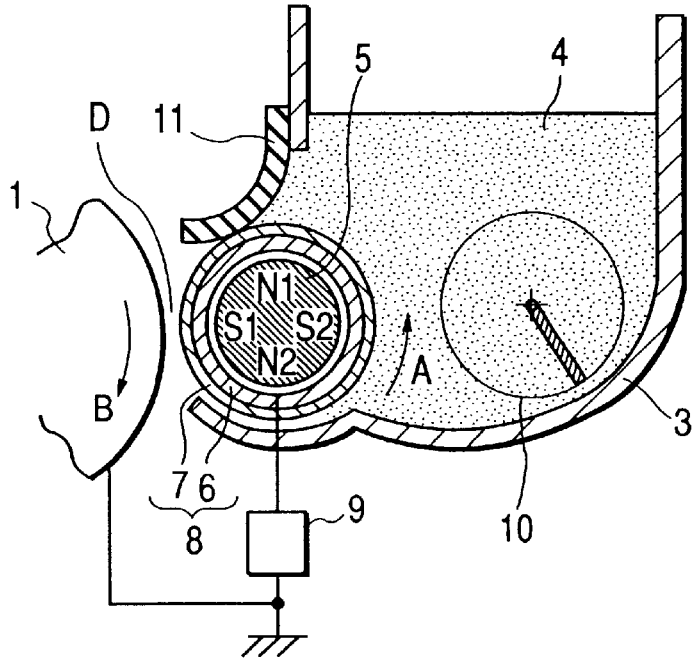
FIG. 2 is a diagrammatic view of a developing apparatus in which a developer carrying member having a resin coat layer and, as a developer layer-thickness regulating member, an elastic blade are used.
Figure 3:
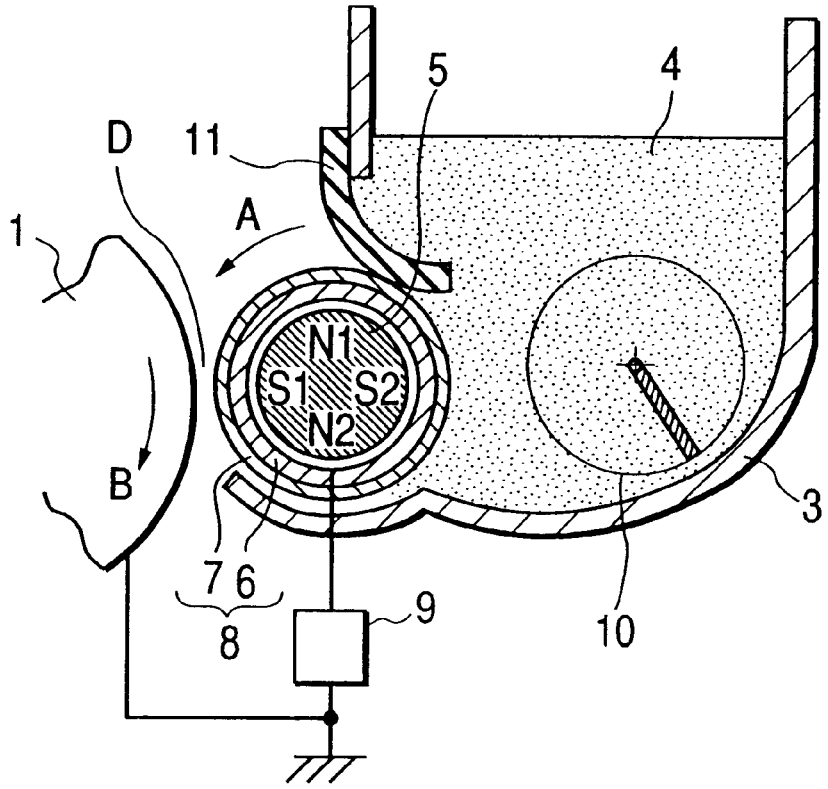
FIG. 3 is a diagrammatic view of a developing apparatus in which a developer carrying member having a resin coat layer and, as a developer layer-thickness regulating member, an elastic blade are used.

FIG. 2 illustrates the construction of another embodiment of the developing apparatus of the present invention. FIG. 3 illustrates the construction of still another embodiment of the developing apparatus of the present invention.

As characteristic features in the developing apparatus shown in FIGS. 2 and 3, an elastic sheet 11 comprised of a material having a rubber elasticity, such as urethane rubber or silicone rubber, or a material having a metal elasticity, such as bronze or stainless steel, is used as a member for regulating the layer thickness of the magnetic toner 4 on the developing sleeve 8. In the developing assembly shown in FIG. 2, this elastic control blade 11 is brought into pressure touch with the developing sleeve 8 in the same direction as its rotational direction. In the developing assembly shown in FIG. 3, it is brought into pressure touch with the developing sleeve 8 in the direction reverse to its rotational direction. In either of such developing apparatus, a much thinner toner layer can be formed on the developing sleeve 8.

The developing apparatus shown in FIGS. 2 and 3 have basically the same construction on others as the developing assembly shown in FIG. 1. In FIGS. 2 and 3, the same reference numerals as those shown in FIG. 1 denote the same members.

The developing apparatus as shown in FIGS. 2 and 3, which are of the type the toner layer is formed on the developing sleeve 8 as described above, are suited for both the case when one-component type magnetic developers composed chiefly of magnetic toners are used and the case when one-component type nonmagnetic developers composed chiefly of nonmagnetic toners are used.

An example of an image forming apparatus employing the developing apparatus of the present invention, exemplified in FIG. 1, will be described below with reference to FIG. 5.

Figure 5:
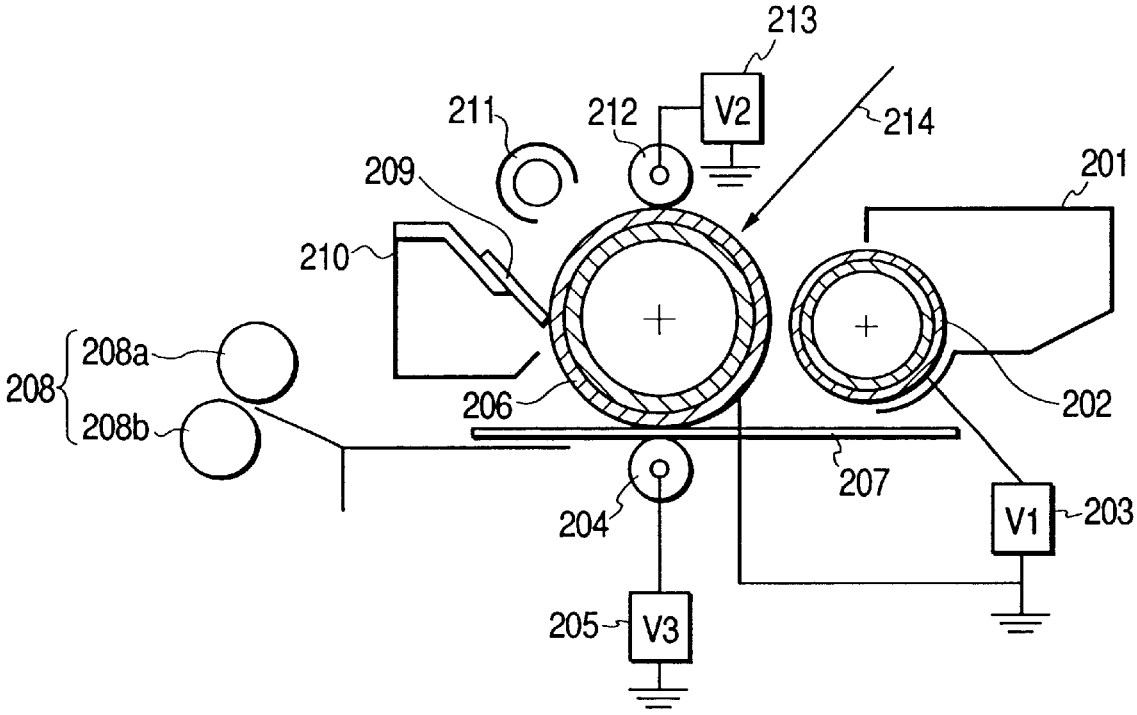
FIG. 5 is a diagrammatic view of an image forming apparatus in which the development system of the present invention is employed.
Figure 6:
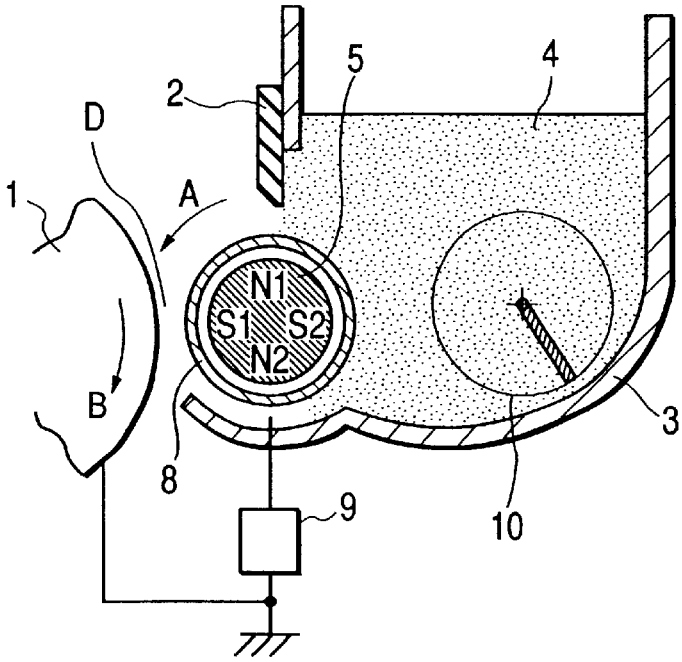
FIG. 6 is a diagrammatic view of a conventional developing apparatus in which a developer carrying member having no resin coat layer is used.

In FIG. 5, reference numeral 206 denotes a rotary drum type photosensitive member serving as the latent image bearing member. The photosensitive member 206 is basically constituted of a conductive substrate layer formed of, e.g., aluminum and a photoconductive layer formed on its periphery. The surface layer portion of the photoconductive layer is constituted of a polycarbonate resin containing a charge-transporting material and 8% by weight of a fluorine type fine resin powder. In the apparatus shown in FIG. 5, the photosensitive member 206 is rotatingly driven in the clockwise direction as viewed in the drawing, at a peripheral speed of, e.g., 200 mm/second.

Reference numeral 212 denotes a charging roller, a contact charging member, serving as the primary charging means, which is basically constituted of a mandrel at the center and provided on its periphery a conductive elastic layer formed of epichlorohydrin rubber containing carbon black. The charging roller 212 is brought into pressure contact with the surface of the photosensitive member 206 under a pressure of 40 g/cm in linear pressure, and is follow-up rotated with the rotation of the photosensitive member 206.

Reference numeral 213 denotes a charging bias power source for applying a voltage to the charging roller 212, and the surface of the photosensitive member 206 is charged uniformly to a polarity-potential of about −700 V upon application of a bias voltage of DC −1.4 kV to the charging roller 212.

Subsequently, as a latent image forming means, electrostatic latent images are formed on the photosensitive member 206 by imagewise exposure 214. The electrostatic latent images formed are developed by a one-component type developer held in a hopper 201 of the developing apparatus and are rendered visible one after another as toner images. Reference numeral 204 denotes a transfer roller as a contact transfer member, which is basically constituted of a mandrel at the center and provided on its periphery a conductive elastic layer formed of an ethylene-propylene-butadiene copolymer containing carbon black.

The transfer roller 204 is brought into pressure contact with the surface of the photosensitive member 206 under a pressure of 20 g/cm in linear pressure, and is rotated at the same speed as the peripheral speed of the photosensitive member 206.

As a recording medium 207, for example an A4-size sheet of paper is used. This recording medium 207 is fed to be held between the photosensitive member 206 and the transfer roller 204, and simultaneously a bias of DC −5 kV with a polarity reverse to that of the toner is applied from a transfer bias power source 205, so that the toner images formed on the photosensitive member 206 are transferred to the surface of the recording medium 207. Thus, at the time of transfer, the transfer roller 204 is brought into pressure contact with the photosensitive member 206 via the recording medium 207.

Next, the recording medium 207 to which the toner images have been transferred is transported to a fixing assembly 208 as a fixing means, which is basically constituted of a fixing roller 208*a* provided internally with a halogen heater, and an elastic material pressure roller 208*b* brought into contact therewith under pressure, and is passed between the fixing roller 208*a* and the pressure roller 208*b*, whereupon the toner images are fixed onto the recording medium 207, and thereafter put out as an image-formed matter.

After the toner images have been transferred, the surface of the photosensitive member 206 is cleaned to remove the adherent contaminants such as toner remaining after transfer, by means of a cleaning device 210 having an elastic cleaning blade 209 formed of polyurethane rubber as a basic material, which is brought into pressure contact with the photosensitive member 206 in the counter direction under a linear pressure of 25 g/cm. The surface is further destaticized by means of a charge eliminating exposure device 211. Then, images are repeatedly formed thereon.

The apparatus unit of the present invention comprises the developing apparatus as shown in FIG. 1, having the developer carrying member of the present invention, the developing apparatus being mounted detachably to the main body of an image forming apparatus (e.g., a copying machine, a laser beam printer or a facsimile machine).

As a form of the apparatus unit, in addition to the developing apparatus shown in FIG. 1, at least one constituent members selected from the drum type latent image bearing member (photosensitive drum) 206, the cleaning means 210 having the cleaning blade 209 and the contact (roller) charging means 212 as a primary charging means which are shown in FIG. 5 may be provided as one unit. Here, any constituent members not selected from the above group e.g., the charging means and/or the cleaning means may be set up on the side of the main body of the apparatus.

Figure 7:
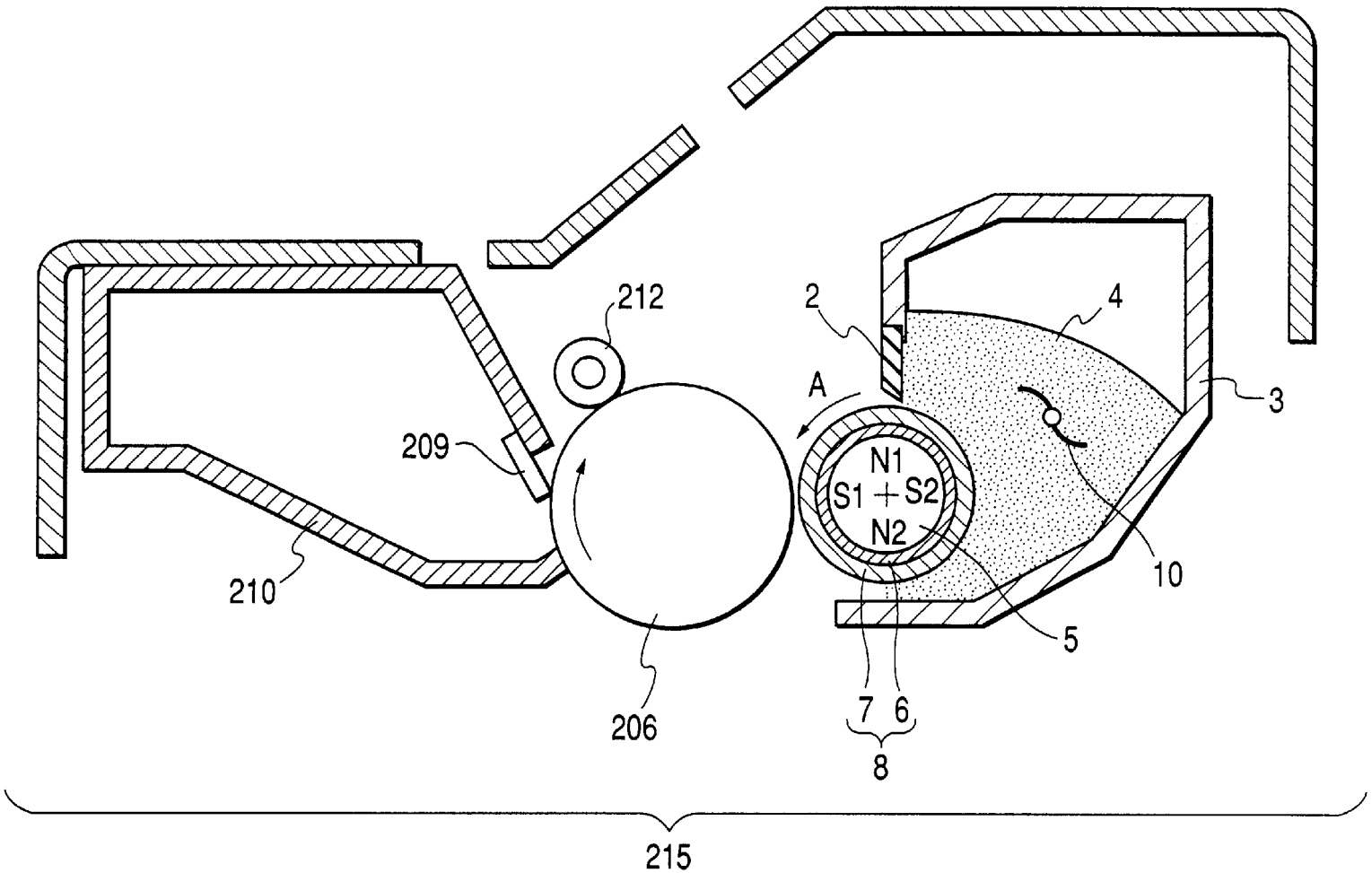
FIG. 7 is a schematic cross-sectional view of an example of the apparatus unit of the present invention.

FIG. 7 illustrates an example of a process cartridge as the apparatus unit of the present invention. In the following description of the process cartridge, constituent members having the same functions as those in the image forming apparatus described with reference to FIG. 5 are denoted by the like reference numerals, except for the developing apparatus shown in FIG. 1.

As shown in FIG. 7, in the process cartridge, at least the developing means and the electrostatic latent image bearing member are joined into one unit as a cartridge, and the process cartridge is so constituted as to be detachably mountable to the main body of the image forming apparatus (e.g., a copying machine, a laser beam printer or a facsimile machine).

In the embodiment of the process cartridge shown in FIG. 7, a process cartridge 215 as the apparatus unit is exemplified in which a developing apparatus, a drum type electrostatic latent image bearing member (photosensitive drum) 206, a cleaning means 210 having a cleaning blade 209 and a contact (roller) charging means 212 as a primary charging means are joined into one unit.

In this embodiment, the developing apparatus is so constituted to have a developing blade 2 and in a hopper 3 as the developer container a one-component type developer 4 having a magnetic toner. At the time of development, a stated electric field is formed across the photosensitive drum 206 and the developing sleeve 8 by applying a development bias voltage from a bias applying means, to carry out the developing step using the developer 4. In order to carry out this developing step preferably, the distance between the photosensitive drum 206 and the developing sleeve 8 is a very important factor.

In the above, an embodiment has been described in which the four constituent members, the developing apparatus, the electrostatic latent image bearing member 206, the cleaning means 210 and the primary charging means 212 are joined into one unit as a cartridge. As the process cartridge, as previously described, at least the developing apparatus may be joined into one unit as a cartridge. For example, it is possible to use two constituent members, the developing apparatus and the electrostatic latent image bearing member, or three constituent members, the developing apparatus, the electrostatic latent image bearing member and the cleaning means, or three constituent members, the developing apparatus, the electrostatic latent image bearing member and the primary charging means, or to add other constituent member(s), so as to be joined together into one unit as a cartridge.

Figure 8:
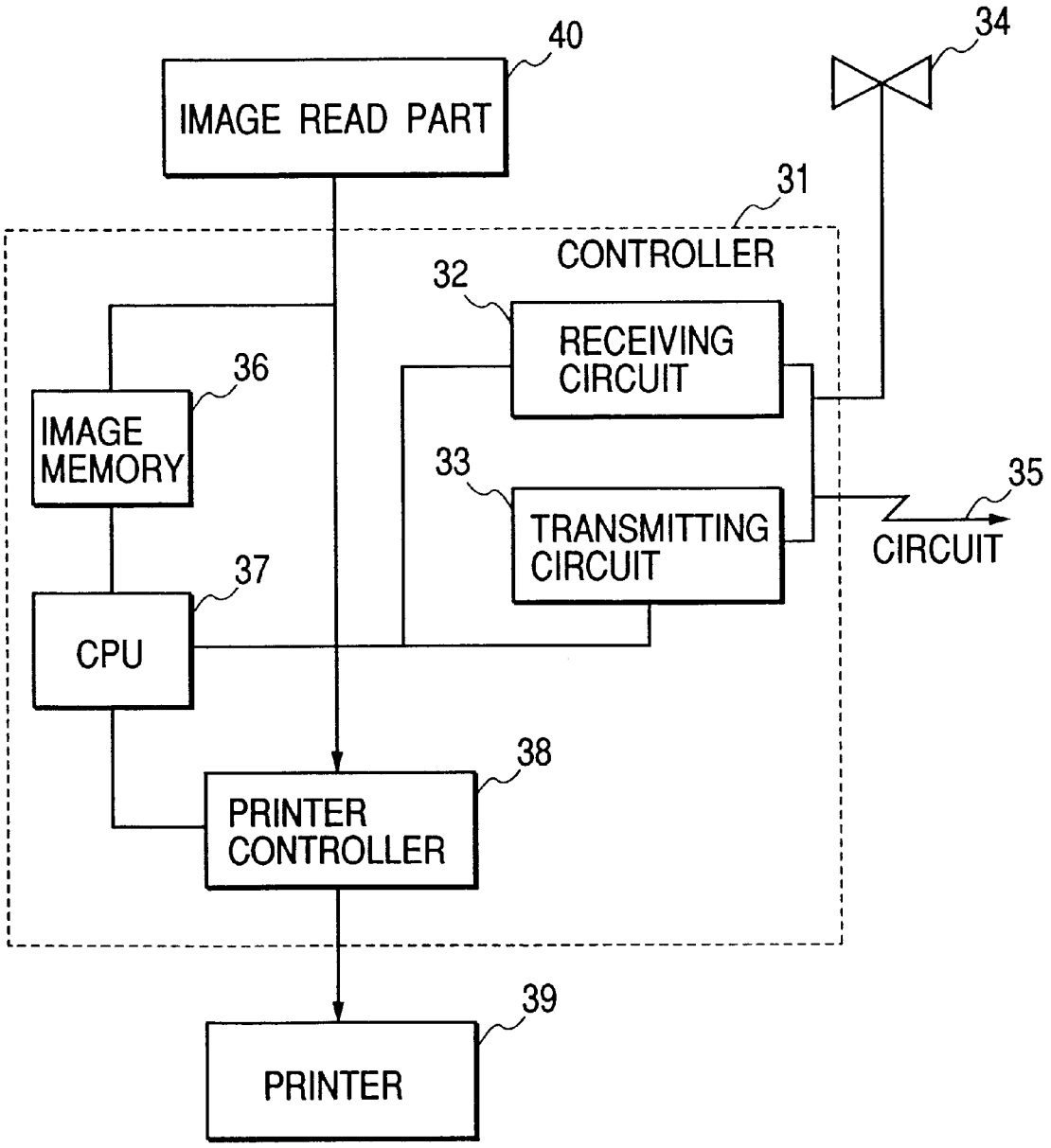
FIG. 8 is a block diagram of an instance where the image forming method of the present invention is applied in a printer of a facsimile transmission system.

An instance where the image forming method of the present invention, characterized by using the developer carrying member according to the present invention as described above, is applied to a printer of a facsimile machine is described below. In this instance, the photo-imagewise exposing light 214 shown in FIG. 5 serves as exposing light used for the printing of received data. FIG. 8 illustrates an example of an image formation process in such an instance, in the form of a block diagram.

A controller 31 controls an image reading part 40 and a printer 39. The whole of the controller 31 is controlled by CPU 37. Image data outputted from the image reading part 40 are sent to the other facsimile station through a transmitting circuit 33. Data received from the other station is sent to a printer 39 through a receiving circuit 32. Stated image data are stored in an image memory 36. A printer controller 38 controls the printer 39. The numeral 34 denotes a telephone.

Images received from a telephone circuit 34 (image information from a remote terminal connected through the circuit) are demodulated in the receiving circuit 32, and then successively stored in an image memory 36 after the image information is decoded by the CPU 37. Then, once images for at least one page have been stored in the memory 36, the image recording for that page is performed. The CPU 37 reads out the image information for one page from the memory 36 and sends the coded image information for one page to the printer controller 38. The printer controller 38, having received the image information for one page from the CPU 37, controls the printer 39 so that the image information for one page is recorded. Incidentally, the CPU 37 receives image information for next page in the course of the recording by the printer 39.

Images are received and recorded in the manner as described above.

As having been described above, in the development of electrostatic latent images by the use of the positively chargeable developer having a positively chargeable toner, the present invention can make the positive charging to the positively chargeable toner rapid and uniform and yet stable, may hardly cause any excessive charging of the positively chargeable toner and its melt-adhesion or contamination to the developer carrying member, and may hardly cause the image density decrease, faulty images and faulty toner coat (blotches) which may otherwise consequently be caused.

The present invention also makes it possible to form stable images even in repeated image reproduction, and enables development promising a good environmental stability.

The present invention brings about the above good effect also when developers having liquid-lubricant-containing toners which are free of contamination to photosensitive members, charging rollers and transfer rollers, have a good releasability and do not cause any blank areas by poor transfer are used especially in the development making use of the positively chargeable developer.

EXAMPLES

The present invention will be described below in greater detail by giving Examples and Comparative Examples. In the following, "%" and "part(s)" appearing in Examples and Comparative Examples are all by weight unless particularly noted.

Example 1

To 100 parts of magnetite particles, 2 parts of dimethylsilicone oil having a viscosity of about 1,000 $mm^2/s$ at room temperature was added to make treatment by means of a mix muller, thus a liquid lubricant dimethylsilicone oil was made to be supported on the particle surfaces of the magnetite particles. Next, using the magnetite thus obtained, a toner used in the present Example was produced in the following way.

| | |
|---|---|
| Styrene-butyl acrylate copolymer (Tg: 58° C.) | 100 parts |
| The above liquid-lubricant-treated magnetite | 75 parts |
| Triphenylmethane compound (charge control agent) | 2 parts |
| Hydrocarbon wax | 4 parts |

The above materials were mixed by means of a Henschel mixer, and the mixture was melt-kneaded and dispersed using a twin-screw extruder. The kneaded product obtained was cooled, which was then finely pulverized by means of a pulverizer making use of jet streams, further followed by classification using an air classifier to obtain a black toner having, in its particle size distribution, a weight-average particle diameter of 7.5 $\mu$m, particles with diameters of 4 $\mu$m or smaller in a number proportion of 15.5% and particles with diameters of 12.7 $\mu$m or larger in a weight proportion of 1.0%. Next, 0.9 part of fine silica powder having a BET specific surface area of about $1.3\times10^5$ $m^2/kg$, having been treated with amino-modified silicone oil having an amine equivalent weight of 830, was externally added and mixed in 100 parts of the black toner by means of a Henschel mixer to obtain an externally silica-added toner. This toner was designated as one-component type positively chargeable magnetic developer 1.

Next, a coating fluid used to form a conductive resin coat layer on the surface of a developing sleeve in the present Example was prepared in the following manner. First, quaternary ammonium salt compound (1) represented by the following formula was used as a charge control agent. On this quaternary ammonium salt compound (1), the polarity of triboelectricity to iron powder was measured by the blow-off process, using a triboelectric charge quantity measuring device Model TB-200 (manufactured by Toshiba Chemical Corporation) to find that it was positive polarity.

(1)

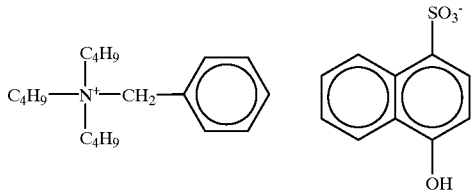

As conductive spherical particles, used were conductive spherical carbon particles obtained by uniformly coating 14 parts of coal bulk-mesophase pitch powder having a number-average particle diameter of 1.5 $\mu$m or smaller, on 100 parts of spherical phenol resin particles having a number-average particle diameter of 5.5 $\mu$m, by means of an automated mortar (manufactured by Ishikawa Kojo), and subjecting the coated particles to thermal stabilization treatment in an oxidizing atmosphere, followed by firing at 2,200° C. to graphitize them. The spherical carbon particles thus obtained had a number-average particle diameter of 5 μm, a true density of 1.50 g/cm$^3$, a volume resistivity of $7.5\times10^{-2}$ Ω·cm and a length/breadth ratio of 1.15. Phenol resin intermediate (solid content: 50%) produced in the presence of ammonia as a catalyst

| | |
|---|---|
| | 200 parts |
| Carbon black | 4 parts |
| Crystalline graphite | 36 parts |
| Quaternary ammonium salt compound (1) represented by the above formula | 30 parts |
| Spherical carbon particles obtained as above, having a number-average particle diameter of 5 μm | 20 parts |
| Methanol | 185 parts |

(as shown in Table 1, P/B/CA/R ratio: 1/2.5/0.75/0.5; CB/GF ratio: 1/9)

Next, using a sand mill, the above materials were dispersed in the following manner. First, to a portion of a methanol solution of the phenol resin intermediate, the carbon black and the crystalline graphite were added to carry out sand-mill dispersion using glass beads as media. To the dispersion obtained, a methanol solution of the remaining phenol resin intermediate in which the quaternary ammonium salt compound had been dispersed and the spherical carbon particles having a number-average particle diameter of 5 μm were added, to further continue the dispersion using the sand-mill to obtain a coating fluid having a solid content of 40%.

The coating fluid thus obtained was coated on an insulating sheet by means of a bar coater, followed by heating and hardening to form a coating film, which was then cut in a standard form, and its volume resistivity was measured with a low-resistivity meter LOW-RESTAR (manufactured by Mitsubishi Yuka Co.) to find that the volume resistivity was $4.9\times10^{0}$ Ω·cm.

Next, using the coating fluid prepared as above, the conductive resin coat layer was formed on the surface of the developing sleeve. As a substrate, used was a cylindrical substrate of 20 mm in outer diameter, made of SUS stainless steel and provided with a magnet roller and a flange. On this substrate, the above coating fluid was coated using a spray gun, and thereafter the wet coating formed was dried and hardened at 150° C. for 30 minutes by means of a hot-air drier to form a conductive resin coat layer having a uniform layer thickness. This was designated as developing sleeve 1 of the present Example.

The conductive resin coat layer from which the carbon, graphite and spherical carbon particles in the composition of this developing sleeve 1 were removed was examined on the polarity of triboelectricity to positive toner model particles to find that it was negative polarity.

The constitution of the conductive resin coat layer thus obtained is summarized in Table 1.

Next, using the one-component type positively chargeable magnetic developer 1 and developing sleeve 1 obtained as above, images were reproduced to make evaluation. Images were reproduced using a copying machine NP6035, manufactured by CANON INC., as an image forming apparatus. This image forming apparatus was in the outline as shown in FIG. 5, having as a developing apparatus the developing apparatus shown in FIG. 1. The developing sleeve 1 of Example 1 was used as the developer carrying member 1 shown in FIG. 1. Images were reproduced in environments of normal temperature/low humidity (N/L) of 24° C./10% RH and high temperature/high humidity (H/H) of 30° C./80% RH on up to 100,000 sheets (100 k).

The results of evaluation made by the following evaluation methods and evaluation criteria are shown in Tables 2 and 3.

Evaluation

Evaluation Methods (1) Image Density:

The density of solid black circles of 5 mm diameter on a test chart having an image percentage of 5.5% was measured as reflection density, using a reflection densitometer RD918 (manufactured by Macbeth Co.). An average value taken on 5 spots was regarded as the image density.

(2) Reversal Fog:

The reflectance of solid white image areas in a proper image was measured and the reflectance of virgin transfer paper was also measured, and the value of (the worst value of reflectance of solid white image areas)—(the highest value of reflectance of virgin transfer paper) was regarded as reversal fog density. A cardboard of 127.9 g/m$^2$ in basis weight was used as the transfer paper, and the reflectance was measured with TC-6DS (manufactured by Tokyo Denshoku Co.). The results are shown in Tables 2 and 3.

Here, with regard to measurement values, when judged visually, an instance of 1.5 or below is on the level the fog is almost not visually recognizable; an instance of from about 2.0 to 3.0 is on the level the fog is recognizable when viewed carefully; and an instance of 4.0 or above is on the level the fog is recognizable at glance. The value of 3.0 or below was evaluated as being within the range of practical use.

(3) Toner Charge Quantity (Q/M) and Toner Transport Quantity (M/S):

The toner carried on the developing sleeve was collected by suction using a metallic cylindrical tube and a cylindrical filter, where charge quantity per unit weight Q/M (mc/kg) and toner weight per unit area M/S (mg/cm$^2$) were calculated from charge quantity Q of charges accumulated in a capacitor through the metallic cylindrical tube, toner weight M of the toner collected and area S in which the toner was sucked, and were regarded as toner charge quantity (Q/M) and toner transport quantity (M/S), respectively. The results are shown in Tables 2 and 3.

(4) Faulty Images:

(lines, uneven images, blotchy images)

Images such as solid black images, halftone images and line images were formed, and these were visually examined, where visual observation was made on any lines, wavy unevenness and blotches (spot-like unevenness) on the developing sleeve and any faulty toner coat on the sleeve. Making reference to these, evaluation was made according to the following ranks. The results are shown in Tables 2 and 3.

A: Not seen at all both on the images and the sleeve.

B: Slightly recognizable on the sleeve, but almost not recognizable on the images.

C: Recognizable on about one sheet in few sheets to tens of sheets when they are looked through.

D: Recognizable on the first sheet of halftone images or solid black images and on the first round of the sleeve rotation.

E: Recognizable on halftone images or solid black images.

F: Faulty images are recognizable on the whole solid black images.

G: Recognizable also on solid white images.

(5) Scrape (film scrape) of Conductive Resin Coat Layer:

After images were reproduced and evaluated in each environment, the developing sleeve was detached and its outer diameter was measured with a laser micrometer Model Y-CTF (manufactured by Magara Keisoku Kaihatsu K.K.). The scrape (amount of scrape) of the conductive resin coat layer on the developing sleeve was calculated from the measurement value thus obtained and the measurement value of outer diameter of the developing sleeve before image reproduction. An average value taken at 30 spots was regarded as film scrape ($\mu$m). The results are shown in Tables 2 and 3.

Example 2

Developing sleeve 2 of the present Example was produced in the same manner as in Example 1 except that the amount (20 parts) of the spherical carbon particles having a number-average particle diameter of 5 $\mu$m which were used therein in forming the conductive resin coat layer was changed to 12 parts based on 200 parts of the phenol resin intermediate (solid content: 50%) and the coating fluid thus prepared was used. Evaluation was made in the same manner as in Example 1.

The constitution of the conductive resin coat layer is shown in Table 1, and the results of evaluation are shown in Tables 2 and 3.

Example 3

Developing sleeve 3 was produced in the same manner as in Example 1 except that the amount (20 parts) of the spherical carbon particles having a number-average particle diameter of 5 $\mu$m which were used therein in forming the conductive resin coat layer was changed to 28 parts based on 200 parts of the phenol resin intermediate (solid content: 50%) and the coating fluid thus prepared was used. Evaluation was made in the same manner as in Example 1.

The constitution of the conductive resin coat layer is shown in Table 1, and the results of evaluation are shown in Tables 2 and 3.

Example 4

Developing sleeve 4 was produced in the same manner as in Example 1 except that the amount (20 parts) of the spherical carbon particles having a number-average particle diameter of 5 $\mu$m which were used therein in forming the conductive resin coat layer was changed to 60 parts based on 200 parts of the phenol resin intermediate (solid content: 50%) and the coating fluid thus prepared was used. Evaluation was made in the same manner as in Example 1.

The constitution of the conductive resin coat layer is shown in Table 1, and the results of evaluation are shown in Tables 2 and 3.

Example 5

Developing sleeve 5 was produced in the same manner as in Example 1 except that the quaternary ammonium salt compound (1) used therein in forming the conductive resin coat layer was replaced with quaternary ammonium salt compound (2) represented by the following formula. Evaluation was made in the same manner as in Example 1.

The constitution of the conductive resin coat layer is shown in Table 1, and the results of evaluation are shown in Tables 2 and 3.

Incidentally, on the quaternary ammonium salt compound (2) represented by the following formula, too, the polarity of triboelectricity to iron powder was measured by the blow-off process, using the triboelectric charge quantity measuring device Model TB-200 (manufactured by Toshiba Chemical Corporation) to find that it was positive polarity.

(2)

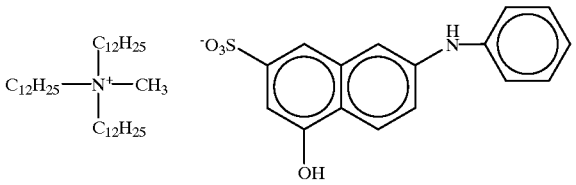

Example 6

Developing sleeve 6 was produced in the same manner as in Example 2 except that the quaternary ammonium salt compound (1) used therein in forming the conductive resin coat layer was replaced with the quaternary ammonium salt compound (2) used in Example 5. Evaluation was made in the same manner as in Example 1.

The constitution of the conductive resin coat layer is shown in Table 1, and the results of evaluation are shown in Tables 2 and 3.

Example 7

Developing sleeve 7 was produced in the same manner as in Example 3 except that the quaternary ammonium salt compound (1) used therein in forming the conductive resin coat layer was replaced with the quaternary ammonium salt compound (2) used in Example 5. Evaluation was made in the same manner as in Example 1.

The constitution of the conductive resin coat layer is shown in Table 1, and the results of evaluation are shown in Tables 2 and 3.

Example 8

Developing sleeve 8 was produced in the same manner as in Example 4 except that the quaternary ammonium salt compound (1) used therein in forming the conductive resin coat layer was replaced with the quaternary ammonium salt compound (2) of the formula (2). Evaluation was made in the same manner as in Example 1.

The constitution of the conductive resin coat layer is shown in Table 1, and the results of evaluation are shown in Tables 2 and 3.

Example 9

Developing sleeve 9 was produced in the same manner as in Example 1 except that the spherical carbon particles having a number-average particle diameter of 5 $\mu$m which were used therein in forming the conductive resin coat layer was replaced with spherical carbon particles having a number-average particle diameter of 2 $\mu$m. Evaluation was made in the same manner as in Example 1.

The constitution of the conductive resin coat layer is shown in Table 1, and the results of evaluation are shown in Tables 2 and 3.

The spherical carbon particles having a number-average particle diameter of 2 $\mu$m which were used in the present Example were conductive spherical carbon particles obtained by uniformly coating 14 parts of coal bulk-mesophase pitch powder having a number-average particle diameter of 0.3 μm or smaller, on 100 parts of spherical phenol resin particles having a number-average particle diameter of 2.3 μm, by means of an automated mortar (manufactured by Ishikawa Kojo), and subjecting the coated particles to thermal stabilization treatment in an oxidizing atmosphere, followed by firing at 2,200° C. to graphitize them; and having a true density of 1.52 g/cm$^3$, a volume resistivity of $7.2\times10^{-2}$ Ω·cm and a length/breadth ratio of 1.12.

Example 10

Developing sleeve 10 was produced in the same manner as in Example 1 except that the spherical carbon particles having a number-average particle diameter of 5 μm which were used therein in forming the conductive resin coat layer was replaced with spherical carbon particles having a number-average particle diameter of 20 μm. Evaluation was made in the same manner as in Example 1.

The constitution of the conductive resin coat layer is shown in Table 1, and the results of evaluation are shown in Tables 2 and 3.

The spherical carbon particles having a number-average particle diameter of 20 μm which were used in the present Example were conductive spherical carbon particles obtained by uniformly coating 14 parts of coal bulk-mesophase pitch powder having a number-average particle diameter of 3 μm or smaller, on 100 parts of spherical phenol resin particles having a number-average particle diameter of 24 μm, by means of an automated mortar (manufactured by Ishikawa Kojo), and subjecting the coated particles to thermal stabilization treatment in an oxidizing atmosphere, followed by firing at 2,200° C. to graphitize them; and having a true density of 1.45 g/cm$^3$, a volume resistivity of $9.6\times10^{-2}$ Ω·cm and a length/breadth ratio of 1.18.

Example 11

Developing sleeve 11 was produced in the same manner as in Example 1 except that the amount (4 parts) of the carbon black and the amount (36 parts) of the crystalline graphite which were used therein in forming the conductive resin coat layer were changed to 5 parts and 45 parts, respectively, based on 200 parts of the phenol resin intermediate (solid content: 50%) and the coating fluid thus prepared was used. Evaluation was made in the same manner as in Example 1.

The constitution of the conductive resin coat layer is shown in Table 1, and the results of evaluation are shown in Tables 2 and 3.

Example 12

Developing sleeve 12 was produced in the same manner as in Example 1 except that the amount (4 parts) of the carbon black and the amount (36 parts) of the crystalline graphite which were used therein in forming the conductive resin coat layer were changed to 3 parts and 30 parts, respectively, based on 200 parts of the phenol resin intermediate (solid content: 50%) and the coating fluid thus prepared was used. Evaluation was made in the same manner as in Example 1.

The constitution of the conductive resin coat layer is shown in Table 1, and the results of evaluation are shown in Tables 2 and 3.

Example 13

Developing sleeve 13 was produced in the same manner as in Example 1 except that the spherical carbon particles having a number-average particle diameter of 5 μm which were used therein in forming the conductive resin coat layer was replaced with carbon-black-coated PMMA particles having a number-average particle diameter of 5 μm. Evaluation was made in the same manner as in Example 1.

The constitution of the conductive resin coat layer is shown in Table 1, and the results of evaluation are shown in Tables 2 and 3.

The carbon-black-coated PMMA particles having a number-average particle diameter of 5 μm which were used in the present Example were conductive spherical PMMA particles obtained by coating 5 parts of conductive carbon black on 100 parts of spherical PMMA particles having a number-average particle diameter of 4.8 μm, by means of a hybridizer (manufactured by Nara Kikai), and having a true density of 1.20 g/cm$^3$, a volume resistivity of $6.8\times10^{-1}$ Ω·cm and a length/breadth ratio of 1.06

Example 14

Developing sleeve 14 was produced in the same manner as in Example 1 except that the spherical carbon particles having a number-average particle diameter of 5 μm which were used therein in forming the conductive resin coat layer was replaced with carbon-black-dispersed resin particles having a number-average particle diameter of 5 μm. Evaluation was made in the same manner as in Example 1.

The constitution of the conductive resin coat layer is shown in Table 1, and the results of evaluation are shown in Tables 2 and 3.

The carbon-black-dispersed resin particles having a number-average particle diameter of 5 μm which were used in the present Example were conductive spherical resin particles obtained by kneading materials shown below, followed by pulverization and classification to obtain conductive resin particles having a number-average particle diameter of 5.3 μm, and thereafter subjecting them to sphering treatment by means of a hybridizer (manufactured by Nara Kikai); and having a true density of 1.21 g/cm$^3$, a volume resistivity of 5.2 Ω·cm and a length/breadth ratio of 1.20.

| | |
|---|---|
| Styrene-dimethylaminoethyl methacrylate-divinylbenzene copolymer (polymerization ratio: 90:10:0.05) | 100 parts |
| Carbon black | 25 parts |

Example 15

Developing sleeve 15 was produced in the same manner as in Example 1 except that the spherical carbon particles having a number-average particle diameter of 5 μm which were used therein in forming the conductive resin coat layer was replaced with PMMA particles having a number-average particle diameter of 5 μm. Evaluation was made in the same manner as in Example 1.

The constitution of the conductive resin coat layer is shown in Table 1, and the results of evaluation are shown in Tables 2 and 3.

Example 16

Developing sleeve 16 was produced in the same manner as in Example 1 except that the coating fluid was replaced with a coating fluid having a solid content of 20% which was prepared using materials shown below. Evaluation was made in the same manner as in Example 1.

The constitution of the conductive resin coat layer is shown in Table 1, and the results of evaluation are shown in Tables 2 and 3.

| | |
|---|---|
| Nylon copolymer composed chiefly of nylon 66 (solid content: 20%) (polyamide resin) | 500 parts |
| Carbon black | 4 parts |
| Crystalline graphite | 36 parts |
| Quaternary ammonium salt compound (1) | 20 parts |
| Spherical carbon particles having a number-average particle diameter of 5 μm | 20 parts |
| Methanol | 320 parts |

Example 17

Developing sleeve 17 was produced in the same manner as in Example 1 except that the coating fluid was replaced with a coating fluid having a solid content of 30% which was prepared using materials shown below. Evaluation was made in the same manner as in Example 1.

The constitution of the conductive resin coat layer is shown in Table 1, and the results of evaluation are shown in Tables 2 and 3.

| | |
|---|---|
| Urethane resin (solid content: 40%) | 250 parts |
| Carbon black | 4 parts |
| Crystalline graphite | 36 parts |
| Quaternary ammonium salt compound (1) | 20 parts |
| Spherical carbon particles having a number-average particle diameter of 5 μm | 20 parts |
| DMF | 270 parts |

Comparative Example 1

Developing sleeve 18 was produced in the same manner as in Example 1 except that the conductive resin coat layer formed therein was not formed and the developing sleeve was replaced with an FGB sleeve the substrate surface of which was sand-blasted with glass beads having particle diameter #300. Evaluation was made in the same manner as in Example 1.

The results of evaluation are shown in Tables 2 and 3.

Comparative Example 2

Developing sleeve 19 was produced in the same manner as in Example 1 except that the quaternary ammonium salt compound (1) and spherical carbon particles having a number-average particle diameter of 5 μm which were used therein in forming the conductive resin coat layer were not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 3

Developing sleeve 20 was produced in the same manner as in Example 1 except that the spherical carbon particles having a number-average particle diameter of 5 μm which were used therein in forming the conductive resin coat layer were not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 4

Developing sleeve 21 was produced in the same manner as in Example 1 except that the spherical carbon particles having a number-average particle diameter of 5 μm which were used therein in forming the conductive resin coat layer was replaced with spherical carbon particles having a number-average particle diameter of 35 μm. Evaluation was made in the same manner as in Example 1.

The constitution of the conductive resin coat layer is shown in Table 1, and the results of evaluation are shown in Tables 2 and 3.

The spherical carbon particles having a number-average particle diameter of 35 μm which were used in the present Example were conductive spherical carbon particles obtained by uniformly coating 14 parts of coal bulk-mesophase pitch powder having a number-average particle diameter of 5 μm or smaller, on 100 parts of spherical phenol resin particles having a number-average particle diameter of 36 μm, by means of an automated mortar (manufactured by Ishikawa Kojo), and subjecting the coated particles to thermal stabilization treatment in an oxidizing atmosphere, followed by firing at 2,200° C. to graphitize them; and having a true density of 1.44 g/cm$^3$, a volume resistivity of $9.8\times10^{-2}$ Ω·cm and a length/breadth ratio of 1.21.

Comparative Example 5

Developing sleeve 22 was produced in the same manner as in Example 1 except that the quaternary ammonium salt compound (1) used therein in forming the conductive resin coat layer was not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 6

Developing sleeve 23 was produced in the same manner as in Example 13 except that the quaternary ammonium salt compound (1) used therein in forming the conductive resin coat layer was not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 7

Developing sleeve 24 was produced in the same manner as in Example 14 except that the quaternary ammonium salt compound (1) used therein in forming the conductive resin coat layer was not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 8

Developing sleeve 25 was produced in the same manner as in Example 15 except that the quaternary ammonium salt compound (1) used therein in forming the conductive resin coat layer was not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 9

Developing sleeve 26 was produced in the same manner as in Example 16 except that the quaternary ammonium salt compound (1) and spherical carbon particles having a number-average particle diameter of 5 μm which were used therein in forming the conductive resin coat layer were not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 10

Developing sleeve 27 was produced in the same manner as in Example 17 except that the quaternary ammonium salt compound (1) and spherical carbon particles having a number-average particle diameter of 5 μm which were used therein in forming the conductive resin coat layer were not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 11

Developing sleeve 28 was produced in the same manner as in Example 1 except that the phenol resin intermediate used therein in forming the conductive resin coat layer was replaced with polymethyl methacrylate, the spherical carbon particles having a number-average particle diameter of 5 μm which were also used therein were not used and the coating fluid thus prepared was used. Evaluation was made in the same manner as in Example 1.

The constitution of the conductive resin coat layer is shown in Table 1, and the results of evaluation are shown in Tables 2 and 3.

Comparative Example 12

Developing sleeve 29 was produced in the same manner as in Example 1 except that the phenol resin intermediate used therein in forming the conductive resin coat layer was replaced with a styrene-acrylate copolymer, the spherical carbon particles having a number-average particle diameter of 5 μm which were also used therein were not used and the coating fluid thus prepared was used. Evaluation was made in the same manner as in Example 1.

The constitution of the conductive resin coat layer is shown in Table 1, and the results of evaluation are shown in Tables 2 and 3.

TABLE 1-1

Resin coat layer constitution in Examples

| | | Resin coat layer characteristics | | | | | | | Spherical particles | |
|---|---|---|---|---|---|---|---|---|---|---|
| | P/B/CA/R ratio*1 | Surface roughness Ra | Layer thickness (μm) | Volume resistivity (Ω · cm) | Polarity of tribo. to posi. toner model | Conductive fine powder CB/GF*2 | Binder resin | Quaternary ammonium salt | Type | Particle diam. (μm ) |
| Example: | | | | | | | | | | |
| 1 | 1/2.5/0.75/0.5 | 0.95 | 16 | $4.9 \times 10^{0}$ | negative | 1/9 | phenol | (1) | carbon | 5 |
| 2 | 1/2.5/0.75/0.3 | 0.78 | 15 | $6.2 \times 10^{0}$ | negative | 1/9 | phenol | (1) | carbon | 5 |
| 3 | 1/2.5/0.75/0.7 | 1.12 | 17 | $3.5 \times 10^{0}$ | negative | 1/9 | phenol | (1) | carbon | 5 |
| 4 | 1/2.5/0.75/1.5 | 1.67 | 18 | $8.8 \times 10^{-1}$ | negative | 1/9 | phenol | (1) | carbon | 5 |
| 5 | 1/2.5/0.75/0.5 | 0.93 | 16 | $5.0 \times 10^{0}$ | negative | 1/9 | phenol | (2) | carbon | 5 |
| 6 | 1/2.5/0.75/0.3 | 0.77 | 15 | $6.4 \times 10^{0}$ | negative | 1/9 | phenol | (2) | carbon | 5 |
| 7 | 1/2.5/0.75/0.7 | 1.11 | 17 | $3.7 \times 10^{0}$ | negative | 1/9 | phenol | (2) | carbon | 5 |
| 8 | 1/2.5/0.75/1.5 | 1.72 | 18 | $8.9 \times 10^{-1}$ | negative | 1/9 | phenol | (2) | carbon | 5 |
| 9 | 1/2.5/0.75/0.5 | 0.74 | 14 | $4.2 \times 10^{0}$ | negative | 1/9 | phenol | (1) | carbon | 2 |
| 10 | 1/2.5/0.75/0.5 | 2.26 | 18 | $5.2 \times 10^{0}$ | negative | 1/9 | phenol | (1) | carbon | 20 |
| 11 | 1/2.0/0.60/0.4 | 1.03 | 16 | $3.9 \times 10^{0}$ | negative | 1/9 | phenol | (1) | carbon | 5 |
| 12 | 1/3.0/0.90/0.6 | 0.88 | 15 | $3.4 \times 10^{1}$ | negative | 1/9 | phenol | (1) | carbon | 5 |
| 13 | 1/2.5/0.75/0.5 | 0.97 | 16 | $2.3 \times 10^{1}$ | negative | 1/9 | phenol | (1) | carbon-coated PMMA | 5 |
| 14 | 1/2.5/0.75/0.5 | 0.92 | 17 | $5.9 \times 10^{1}$ | negative | 1/9 | phenol | (1) | carbon-dispersed resin | 5 |
| 15 | 1/2.5/0.75/0.5 | 0.96 | 17 | $7.2 \times 10^{1}$ | negative | 1/9 | phenol | (1) | PMMA | 5 |
| 16 | 1/2.5/0.50/0.5 | 1.03 | 14 | $1.2 \times 10^{1}$ | negative | 1/9 | polyamide | (1) | carbon | 5 |
| 17 | 1/2.5/0.50/0.5 | 1.05 | 15 | $1.4 \times 10^{1}$ | negative | 1/9 | urethane | (1) | carbon | 5 |

*1P: conductive fine powder, B: binder resin, CA: quaternary ammonium salt compound, R: spherical particles

*2Carbon black (CB)/crystalline graphite (GF) ratio

TABLE 1-2

Resin coat layer constitution in Comparative Examples

| | P/B/CA/R ratio*1 | Resin coat layer characteristics: Surface roughness Ra | Layer thickness (μm) | Volume resistivity (Ω · cm) | Polarity of tribo. to posi. toner model | Conductive fine powder CB/GF*2 | Binder resin | Quaternary ammonium salt | Spherical particles: Type | Particle diam. (μm ) |
|---|---|---|---|---|---|---|---|---|---|---|
| Comparative Example: | | | | | | | | | | |
| 1 | Developing sleeve sand-blasted with glass beads of particle diameter #300 (Ra: 0.55) | | | | | | | | | |
| 2 | 1/2.5/—/— | 0.52 | 9 | $1.7 \times 10^{0}$ | positive | 1/9 | phenol | none | none | — |
| 3 | 1/2.5/0.75/— | 0.48 | 12 | $1.2 \times 10^{1}$ | negative | 1/9 | phenol | (1) | none | — |
| 4 | 1/2.5/0.75/0.5 | 3.69 | 19 | $1.8 \times 10^{1}$ | negative | 1/9 | phenol | (1) | carbon | 35 |
| 5 | 1/2.5/—/0.5 | 1.03 | 14 | $9.8 \times 10^{-1}$ | positive | 1/9 | phenol | none | carbon | 5 |
| 6 | 1/2.5/—/0.5 | 1.04 | 14 | $1.1 \times 10^{-1}$ | positive | 1/9 | phenol | none | carbon-coated PMMA | 5 |
| 7 | 1/2.5/—/0.5 | 1.07 | 15 | $2.3 \times 10^{1}$ | positive | 1/9 | phenol | none | carbon-dispersed resin | 5 |
| 8 | 1/2.5/—/0.5 | 1.06 | 15 | $3.4 \times 10^{1}$ | positive | 1/9 | phenol | none | PMMA | 5 |
| 9 | 1/2.5/—/— | 0.46 | 9 | $6.4 \times 10^{0}$ | positive | 1/9 | polyamide | none | none | — |
| 10 | 1/2.5/—/— | 0.51 | 10 | $7.1 \times 10^{0}$ | positive | 1/9 | urethane | none | none | — |
| 11 | 1/2.5/0.75/— | 0.63 | 14 | $3.1 \times 10^{1}$ | positive | 1/9 | PMMA | (1) | none | — |
| 12 | 1/2.5/0.75/— | 0.65 | 13 | $3.5 \times 10^{1}$ | positive | 1/9 | styrene/acrylate | (1) | none | — |

*1P: conductive fine powder, B: binder resin, CA: quaternary ammonium salt compound, R: spherical particles

*2Carbon black (CB)/crystalline graphite (GF) ratio

TABLE 2-1

Evaluation in N/L environment in Examples

| | Initial stage (after 1k): Image density | Reversal fog | Q/M (mC/kg) | M/S (mg/cm$^2$) | (1) | (2) | Running (after 100k): Image density | Reversal fog | Q/M (mC/kg) | M/S (mg/cm$^2$) | (1) | (2) | Film scrape (μm) |
|---|---|---|---|---|---|---|---|---|---|---|---|---|---|
| Example: | | | | | | | | | | | | | |
| 1 | 1.35 | 1.9 | 15.7 | 1.13 | A | A | 1.38 | 1.2 | 15.3 | 1.03 | A | A | −3.3 |
| 2 | 1.36 | 1.7 | 15.9 | 1.02 | A | A | 1.37 | 1.0 | 15.5 | 0.92 | B | A | −3.4 |
| 3 | 1.34 | 2.0 | 15.4 | 1.25 | A | A | 1.38 | 1.3 | 14.9 | 1.14 | A | A | −3.2 |
| 4 | 1.33 | 2.5 | 14.6 | 1.46 | B | A | 1.37 | 1.7 | 14.1 | 1.35 | A | A | −2.9 |
| 5 | 1.36 | 1.9 | 15.6 | 1.14 | A | A | 1.38 | 1.2 | 15.4 | 1.04 | A | A | −3.2 |
| 6 | 1.35 | 1.8 | 16.1 | 1.04 | A | A | 1.37 | 1.1 | 15.8 | 0.94 | B | A | −3.4 |
| 7 | 1.35 | 2.1 | 15.5 | 1.24 | A | A | 1.39 | 1.4 | 15.0 | 1.13 | A | A | −3.1 |
| 8 | 1.32 | 2.4 | 14.7 | 1.48 | B | A | 1.36 | 1.6 | 14.3 | 1.37 | A | A | −2.8 |
| 9 | 1.35 | 1.7 | 15.8 | 1.06 | A | A | 1.35 | 1.1 | 15.2 | 0.93 | B | A | −3.8 |
| 10 | 1.29 | 2.9 | 13.6 | 1.66 | C | B | 1.32 | 2.1 | 13.1 | 1.49 | B | B | −2.6 |
| 11 | 1.34 | 1.8 | 14.5 | 0.98 | A | A | 1.35 | 1.0 | 14.1 | 0.84 | A | A | −4.0 |
| 12 | 1.32 | 2.3 | 16.6 | 0.86 | B | A | 1.34 | 1.7 | 15.7 | 0.81 | B | A | −3.0 |
| 13 | 1.32 | 2.1 | 14.7 | 1.10 | B | A | 1.32 | 1.4 | 14.3 | 0.93 | B | A | −4.6 |
| 14 | 1.32 | 2.2 | 14.3 | 1.11 | B | A | 1.31 | 1.5 | 14.0 | 0.92 | B | A | −4.7 |
| 15 | 1.29 | 2.6 | 13.8 | 1.09 | C | B | 1.28 | 1.8 | 13.0 | 0.83 | C | B | −4.9 |
| 16 | 1.36 | 1.8 | 15.7 | 1.15 | A | A | 1.39 | 1.1 | 15.2 | 1.07 | A | A | −3.3 |
| 17 | 1.35 | 1.9 | 15.6 | 1.16 | A | A | 1.38 | 1.1 | 15.1 | 1.05 | A | A | −3.4 |

(1): Lines and uneven images, (2): Blotchy images

TABLE 2-2

Evaluation in N/L environment in Comparative Examples

| | Initial stage (after 1k) | | | | | | Running (after 100k) | | | | | | |
|---|---|---|---|---|---|---|---|---|---|---|---|---|---|
| | Image density | Reversal fog | Q/M (mC/kg) | M/S (mg/cm$^2$) | (1) | (2) | Image density | Reversal fog | Q/M (mC/kg) | M/S (mg/cm$^2$) | (1) | (2) | Film scrape ($\mu$m) |
| Comparative Example: | | | | | | | | | | | | | |
| 1 | 1.24 | 3.8 | 7.5 | 0.61 | E | F | 1.20 | 2.9 | 6.7 | 0.49 | F | G | — |
| 2 | 1.25 | 3.2 | 7.8 | 0.69 | D | D | 1.23 | 2.5 | 7.2 | 0.61 | E | E | −0.9 |
| 3 | 1.35 | 1.8 | 16.3 | 0.83 | A | A | 1.32 | 1.2 | 12.9 | 0.71 | D | B | −6.1 |
| 4 | 1.25 | 3.9 | 9.6 | 2.01 | D | D | 1.24 | 3.2 | 9.1 | 1.78 | F | E | −1.9 |
| 5 | 1.26 | 3.0 | 8.1 | 1.11 | D | C | 1.24 | 2.4 | 7.4 | 1.01 | E | D | −1.5 |
| 6 | 1.25 | 3.2 | 8.0 | 1.10 | D | C | 1.23 | 2.6 | 7.3 | 0.99 | E | D | −1.8 |
| 7 | 1.25 | 3.3 | 7.9 | 1.08 | D | C | 1.22 | 2.7 | 7.2 | 0.97 | E | D | −2.0 |
| 8 | 1.24 | 3.6 | 7.6 | 1.09 | D | C | 1.21 | 2.8 | 6.8 | 0.89 | E | E | −3.9 |
| 9 | 1.23 | 3.4 | 7.0 | 0.66 | E | D | 1.19 | 2.8 | 6.3 | 0.59 | F | E | −0.9 |
| 10 | 1.22 | 3.3 | 7.1 | 0.67 | E | D | 1.18 | 2.9 | 6.4 | 0.58 | F | E | −1.2 |
| 11 | 1.08 | 5.6 | 4.1 | 0.72 | E | D | 0.97 | 5.4 | 3.0 | 0.60 | F | E | −8.6 |
| 12 | 1.06 | 5.8 | 4.0 | 0.73 | E | D | 0.95 | 5.5 | 2.9 | 0.61 | F | E | −8.9 |

(1): Lines and uneven images,
(2): Blotchy images

TABLE 3-1

Evaluation in H/H environment in Examples

| | Initial stage (after 1k) | | | | | | Running (after 100k) | | | | | | |
|---|---|---|---|---|---|---|---|---|---|---|---|---|---|
| | Image density | Reversal fog | Q/M (mC/kg) | M/S (mg/cm$^2$) | (1) | (2) | Image density | Reversal fog | Q/M (mC/kg) | M/S (mg/cm$^2$) | (1) | (2) | Film scrape ($\mu$m) |
| Example: | | | | | | | | | | | | | |
| 1 | 1.31 | 1.3 | 14.5 | 1.12 | A | A | 1.33 | 0.8 | 14.0 | 0.99 | A | A | −3.5 |
| 2 | 1.32 | 1.1 | 14.7 | 1.01 | B | A | 1.32 | 0.7 | 14.1 | 0.88 | B | A | −3.6 |
| 3 | 1.30 | 1.4 | 14.2 | 1.23 | A | A | 1.32 | 0.9 | 13.8 | 1.10 | A | A | −3.4 |
| 4 | 1.29 | 1.9 | 13.4 | 1.44 | B | A | 1.30 | 1.4 | 12.9 | 1.30 | B | A | −3.0 |
| 5 | 1.32 | 1.3 | 14.4 | 1.13 | A | A | 1.33 | 0.8 | 13.9 | 1.0O | A | A | −3.4 |
| 6 | 1.31 | 1.2 | 14.9 | 1.03 | B | A | 1.31 | 0.7 | 14.3 | 0.90 | B | A | −3.6 |
| 7 | 1.31 | 1.5 | 14.3 | 1.22 | A | A | 1.33 | 1.o | 13.8 | 1.09 | A | A | −3.3 |
| 8 | 1.28 | 1.8 | 13.5 | 1.46 | B | A | 1.30 | 1.3 | 13.0 | 1.33 | B | A | −3.1 |
| 9 | 1.31 | 1.1 | 14.6 | 1.04 | C | A | 1.30 | 0.7 | 13.9 | 0.89 | C | A | −4.1 |
| 10 | 1.26 | 2.3 | 12.4 | 1.63 | D | B | 1.26 | 1.8 | 11.8 | 1.43 | D | B | −2.7 |
| 11 | 1.29 | 1.2 | 13.3 | 0.96 | C | A | 1.29 | 0.7 | 12.6 | 0.83 | C | A | −4.3 |
| 12 | 1.30 | 1.7 | 15.1 | 0.85 | B | A | 1.32 | 1.3 | 14.4 | 0.75 | A | A | −3.2 |
| 13 | 1.28 | 1.5 | 13.3 | 1.08 | C | A | 1.29 | 1.0 | 12.8 | 0.95 | C | A | −4.8 |
| 14 | 1.28 | 1.6 | 12.9 | 1.09 | G | A | 1.29 | 1.1 | 12.4 | 0.96 | C | A | −4.9 |
| 15 | 1.25 | 2.1 | 12.4 | 1.06 | D | B | 1.26 | 1.6 | 11.8 | 0.89 | D | B | −5.1 |
| 16 | 1.32 | 1.2 | 14.6 | 1.14 | A | A | 1.33 | 0.8 | 14.2 | 1.01 | A | A | −3.4 |
| 17 | 1.31 | 1.3 | 14.5 | 1.15 | A | A | 1.32 | 0.9 | 13.9 | 1.01 | A | A | −3.6 |

(1): Lines and uneven images,
(2): Blotchy images

TABLE 3-2

Evaluation in H/H environment in Comparative Examples

| | Initial stage (after 1k) | | | | | | Running (after 100k) | | | | | | |
|---|---|---|---|---|---|---|---|---|---|---|---|---|---|
| | Image density | Reversal fog | Q/M (mC/kg) | M/S (mg/cm$^2$) | (1) | (2) | Image density | Reversal fog | Q/M (mC/kg) | M/S (mg/cm$^2$) | (1) | (2) | Film scrape ($\mu$m) |
| Comparative Example: | | | | | | | | | | | | | |
| 1 | 1.18 | 3.1 | 6.2 | 0.59 | F | E | 1.15 | 2.4 | 5.6 | 0.46 | G | F | — |
| 2 | 1.19 | 2.5 | 6.5 | 0.68 | E | C | 1.16 | 1.8 | 6.0 | 0.56 | F | D | −1.1 |
| 3 | 1.30 | 1.2 | 15.0 | 0.81 | C | A | 1.28 | 0.6 | 11.9 | 0.68 | D | B | −6.3 |
| 4 | 1.20 | 3.2 | 8.3 | 1.97 | E | C | 1.17 | 2.5 | 7.8 | 1.75 | F | D | −2.2 |

TABLE 3-2-continued

Evaluation in H/H environment in Comparative Examples

| | Initial stage (after 1k) | | | | | | Running (after 100k) | | | | | | |
|---|---|---|---|---|---|---|---|---|---|---|---|---|---|
| | Image density | Reversal fog | Q/M (mC/kg) | M/S (mg/cm$^2$) | (1) | (2) | Image density | Reversal fog | Q/M (mC/kg) | M/S (mg/cm$^2$) | (1) | (2) | Film scrape ($\mu$m) |
| 5 | 1.21 | 2.3 | 6.8 | 1.08 | E | B | 1.18 | 1.6 | 6.3 | 0.95 | F | C | −1.7 |
| 6 | 1.21 | 2.5 | 6.7 | 1.07 | E | B | 1.18 | 1.8 | 6.2 | 0.94 | F | C | −2.0 |
| 7 | 1.20 | 2.6 | 6.6 | 1.05 | E | B | 1.17 | 1.9 | 6.1 | 0.91 | F | C | −2.2 |
| 8 | 1.19 | 2.9 | 6.3 | 1.04 | E | C | 1.15 | 2.2 | 5.7 | 0.87 | F | D | −4.2 |
| 9 | 1.16 | 2.7 | 5.7 | 0.63 | F | D | 1.12 | 2.0 | 5.1 | 0.51 | G | E | −1.1 |
| 10 | 1.17 | 2.7 | 5.8 | 0.64 | F | D | 1.13 | 2.0 | 5.3 | 0.49 | G | E | −1.5 |
| 11 | 1.01 | 5.0 | 2.7 | 0.70 | F | D | 0.89 | 4.9 | 2.0 | 0.56 | G | E | −8.9 |
| 12 | 1.00 | 5.2 | 2.6 | 0.71 | F | D | 0.88 | 5.0 | 1.9 | 0.57 | G | E | −9.2 |

(1): Lines and uneven images,
(2): Blotchy images

What is claimed is:

1. A developing apparatus comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein;

said developer comprises a positively chargeable toner having a weight-average particle diameter of 5 to 10 $\mu$m, said developer carrying member has at least a substrate and a resin coat layer formed of a resin composition on the surface of the substrate;

said resin composition containing at least (I) a binder resin having a structure selected from the group consisting of an —$NH_2$ group, an ═NH group and an —NH— linkage, (II) a conductive fine powder, (III) spherical particles having a number-average particle diameter of from 0.3 $\mu$m to 30 $\mu$m and (IV) a quaternary ammonium salt compound which is positively chargeable to iron powder, represented by the following general formula:

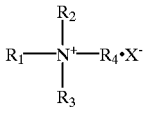

wherein $R_1$, $R_2$, $R_3$ and $R_4$ each represent a member selected from the group consisting of an alkyl group, an aryl group, and an aralkyl group, and may be the same or different from one another, and $X^-$ represents an anion.

2. The developing apparatus according to claim 1, wherein said spherical particles have a number-average particle diameter in the range of 2 $\mu$m to 20 $\mu$m.

3. The developing apparatus according to claim 1, wherein said spherical particles have a true density of 3 g/cm$^3$ or lower.

4. The developing apparatus according to claim 1, wherein said spherical particles have a true density of 2.7 g/cm$^3$ or lower.

5. The developing apparatus according to claim 1, wherein said spherical particles have a true density in the range of 0.9 g/cm$^3$ to 2.5 g/cm$^3$.

6. The developing apparatus according to claim 1, wherein said spherical particles have a length/breadth ratio in the range of 1.0 to 1.5.

7. The developing apparatus according to claim 1, wherein said spherical particles have a length/breadth ratio in the range of 1.0 to 1.2.

8. The developing apparatus according to claim 1, wherein said spherical particles are spherical resin particles.

9. The developing apparatus according to claim 8, wherein said spherical resin particles have been surface-treated with an inorganic fine powder.

10. The developing apparatus according to claim 8, wherein said spherical resin particles have been surface-treated with a coupling agent.

11. The developing apparatus according to claim 1, wherein said resin particles are conductive spherical particles having a true density of 3 g/cm$^3$ or lower.

12. The developing apparatus according to claim 11, wherein said conductive spherical particles have a volume resistivity of $10^6$ Ω·cm or lower.

13. The developing apparatus according to claim 11, wherein said conductive spherical particles have a volume resistivity in the range of $10^{-6}$ Ωm to $10^3$ Ω·cm.

14. The developing apparatus according to claim 11, wherein said conductive spherical particles comprise spherical resin particles having been carbonized by firing.

15. The developing apparatus according to claim 11, wherein said conductive spherical particles comprise spherical mesocarbon microbeads having been graphitized by firing.

16. The developing apparatus according to claim 11, wherein said conductive spherical particles have been carbonized inside and graphitized outside.

17. The developing apparatus according to claim 16, wherein said conductive spherical particles are particles obtained by coating a bulk-mesophase pitch on the surfaces of spherical resin particles, and heating the coated particles in an oxidizing atmosphere, followed by firing in an inert atmosphere or in vacuo.

18. The developing apparatus according to claim 11, wherein said conductive spherical particles have been coated with at least one of a conductive metal and a conductive metal oxide.

19. The developing apparatus according to claim 11, wherein said conductive spherical particles comprise spherical particles whose surfaces have been conductive-treated.

20. The developing apparatus according to claim 19, wherein said conductive spherical particles are particles obtained by making conductive fine particles adhere to the surfaces of spherical resin particles and imparting a mechanical impact to the resultant particles.

21. The developing apparatus according to claim 11, wherein said conductive spherical particles comprise spherical resin particles having conductive fine particles dispersed therein.

22. The developing apparatus according to claim 21, wherein said conductive spherical particles are particles obtained by kneading a resin and conductive fine particles, cooling the resultant kneaded product to solidify, pulverizing the resultant solidified product, and sphering the resultant pulverized product by at least one of a mechanical treatment and a thermal treatment.

23. The developing apparatus according to claim 1, wherein said resin particles are conductive spherical particles having a true density of 2.7 g/cm$^3$ or lower.

24. The developing apparatus according to claim 1, wherein said resin particles are conductive spherical particles having a true density in the range of 0.9 g/cm$^3$ to 2.5 g/cm$^3$.

25. The developing apparatus according to claim 1, wherein said resin coat layer contains resin particles in an amount of from 2 to 120 parts by weight based on 100 parts by weight of the binder resin.

26. The developing apparatus according to claim 1, wherein said anion comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

27. The developing apparatus according to claim 1, wherein said resin coat layer contains said quaternary ammonium salt compound in an amount of from 1 part by weight to 100 parts by weight based on 100 parts by weight of the binder resin.

28. The developing apparatus according to claim 1, wherein said binder resin is a resin selected from the group consisting of a phenol resin, a polyamide resin, and a polyurethane resin.

29. The developing apparatus according to claim 1, wherein said resin coat layer has a center-line surface roughness Ra of from 0.2 to 3.5.

30. The developing apparatus according to claim 1, wherein said positively chargeable developer is a one-component type developer having a positively chargeable magnetic toner.

31. The developing apparatus according to claim 1, wherein said positively chargeable developer is a one-component type developer having a positively chargeable non-magnetic toner.

32. The developing apparatus according to claim 1, wherein said positively chargeable toner contains a release agent.

33. The developing apparatus according to claim 1, wherein said positively chargeable toner contains a positive charge control agent.

34. The developing apparatus according to claim 1, wherein said positively chargeable developer comprises a positively chargeable toner and an external additive treated with a liquid lubricant.

35. The developing apparatus according to claim 1, wherein said positively chargeable toner contains a colorant having at least one of a liquid lubricant supported thereon and a magnetic powder having a liquid lubricant supported thereon.

36. The developing apparatus according to claim 1, wherein the thickness of the positively chargeable developer layer to be formed on said developer carrying member is smaller than the minimum gap between the surface of said developer carrying member and the surface of an electrostatic latent image bearing member.

37. The developing apparatus according to claim 1, which comprises a power source for applying a bias voltage to said developer carrying member.

38. The developing apparatus according to claim 37, wherein said bias voltage has an alternating bias voltage on which a direct current component has been superimposed.

39. The developing apparatus according to claim 1, wherein said positively chargeable toner has, in its particle size distribution, a weight-average particle diameter in the range of 5 $\mu$m to 10 $\mu$m.

40. An apparatus unit detachably mountable on the main assembly of an image forming apparatus; the unit comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein;

said developer comprises a positively chargeable toner having a weight-average particle diameter of 5 to 10 $\mu$m, said developer carrying member has at least a substrate and a resin coat layer formed of a resin composition on the surface of the substrate;

said resin composition containing at least (I) a binder resin having a structure selected from the group consisting of an —$NH_2$ group, an =NH group and an —NH linkage, (II) a conductive fine powder, (III) spherical particles having a number-average particle diameter of from 0.3 $\mu$m to 30 $\mu$m and (IV) a quaternary ammonium salt compound which is positively chargeable to iron powder, represented by the following general formula:

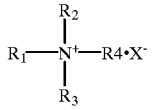

wherein $R_1$, $R_2$, $R_3$ and $R_4$ each represent a member selected from the group consisting of an alkyl group, an aryl group, and an aralkyl group, and may be the same or different from one another; and $X^-$ represents an anion.

41. The apparatus unit according to claim 40, wherein said spherical particles have a number-average particle diameter in the range of 2 $\mu$m to 20 $\mu$m.

42. The apparatus unit according to claim 40, wherein said spherical particles have a true density of 3 q/cm$^3$ or lower.

43. The apparatus unit according to claim 40, wherein said spherical particles have a true density of 2.7 g/cm$^3$ or lower.

44. The apparatus unit according to claim 40, wherein said spherical particles have a true density of from 0.9 g/cm$^3$ to 2.5 g/cm$^3$.

45. The apparatus unit according to claim 40, wherein said spherical particles have a length/breadth ratio in the range of 1.0 to 1.5.

46. The apparatus unit according to claim 40, wherein said spherical particles have a length/breadth ratio in the range of 1.0 to 1.2.

47. The apparatus unit according to claim 40, wherein said spherical particles are spherical resin particles.

48. The apparatus unit according to claim 47, wherein said spherical resin particles have been surface-treated with an inorganic fine powder.

49. The apparatus unit according to claim 47, wherein said spherical resin particles have been surface-treated with a coupling agent.

50. The apparatus unit according to claim 40, wherein said resin particles are conductive spherical particles having a true density of 3 g/cm$^3$ or lower.

51. The apparatus unit according to claim 50, wherein said conductive spherical particles have a volume resistivity of $10^6$ Ω·cm or lower.

52. The apparatus unit according to claim 50, wherein said conductive spherical particles have a volume resistivity in the range of $10^{-6}$ Ω·cm to $10^3$ Ω·cm.

53. The apparatus unit according to claim 50, wherein said conductive spherical particles comprise spherical resin particles having been carbonized by firing.

54. The apparatus unit according to claim 50, wherein said conductive spherical particles comprise spherical mesocarbon microbeads having been graphitized by firing.

55. The apparatus unit according to claim 50, wherein said conductive spherical particles have been carbonized inside and graphitized outside.

56. The apparatus unit according to claim 51, wherein said conductive spherical particles are particles obtained by coating a bulk-mesophase pitch on the surfaces of spherical resin particles, and heating the coated particles in an oxidizing atmosphere, followed by firing the oxidized, coated particles in an inert atmosphere or in vacuo.

57. The apparatus unit according to claim 50, wherein said conductive spherical particles have been coated with at least one of a conductive metal and a conductive metal oxide.

58. The apparatus unit according to claim 50, wherein said conductive spherical particles comprise spherical particles whose surfaces have been conductive-treated.

59. The apparatus unit according to claim 58, wherein said conductive spherical particles are particles obtained by making conductive fine particles adhere to the surfaces of spherical resin particles and imparting a mechanical impact to the resultant particles.

60. The apparatus unit according to claim 50, wherein said conductive spherical particles comprise spherical resin particles having conductive fine particles dispersed therein.

61. The apparatus unit according to claim 60, wherein said conductive spherical particles are particles obtained by kneading a resin and conductive fine particles, cooling the resultant kneaded product to solidify, pulverizing the resultant solidified product, and sphering the resultant pulverized product by at least one of a mechanical treatment and a thermal treatment.

62. The apparatus unit according to claim 40, wherein said resin particles are conductive spherical particles having a true density of 2.7 g/cm$^3$ or lower.

63. The apparatus unit according to claim 40, wherein said resin particles are conductive spherical particles having a true density in the range of 0.9 g/cm$^3$ to 2.5 g/cm$^3$.

64. The apparatus unit according to claim 40, wherein said resin coat layer contains resin particles in an amount of from 2 to 120 parts by weight based on 100 parts by weight of the binder resin.

65. The apparatus unit according to claim 40, wherein said anion comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

66. The apparatus unit according to claim 40, wherein said resin coat layer contains said quaternary ammonium salt compound in an amount of from 1 part by weight to 100 parts by weight based on 100 parts by weight of the binder resin.

67. The apparatus unit according to claim 40, wherein said binder resin is a resin selected from the group consisting of a phenol resin, a polyamide resin, and a polyurethane resin.

68. The apparatus unit according to claim 40, wherein said resin coat layer has a center-line surface roughness Ra of from 0.2 to 3.5.

69. The apparatus unit according to claim 40, wherein said positively chargeable developer is a one-component type developer having a positively chargeable magnetic toner.

70. The apparatus unit according to claim 40, wherein said positively chargeable developer is a one-component type developer having a positively chargeable nonmagnetic toner.

71. The apparatus unit according to claim 40, wherein said positively chargeable toner contains a release agent.

72. The apparatus unit according to claim 40, wherein said positively chargeable toner contains a positive charge control agent.

73. The apparatus unit according to claim 40, wherein said positively chargeable developer comprises the positively chargeable toner and an external additive treated with a liquid lubricant.

74. The apparatus unit according to claim 40, wherein said positively chargeable toner contains a colorant including at least one of a liquid lubricant supported thereon and a magnetic powder having a liquid lubricant supported thereon.

75. The apparatus unit according to claim 40, wherein the thickness of the positively chargeable developer layer to be formed on said developer carrying member is smaller than the minimum gap between the surface of said developer carrying member and the surface of an electrostatic latent image bearing member.

76. The apparatus unit according to claim 40, wherein a bias voltage is applied to said developer carrying member at the time of development.

77. The apparatus unit according to claim 76, wherein said bias voltage has an alternating bias voltage on which a direct current component has been superimposed.

78. The apparatus unit according to claim 40, which further comprises an electrostatic latent image held as one unit.

79. The apparatus unit according to claim 40, wherein said positively chargeable toner has, in its particle size distribution, a weight-average particle diameter in the range of 5 μm to 10 μm.

80. An image forming method comprising the steps of:

a latent image forming step of forming an electrostatic latent image on a latent image bearing member; and a developer step of developing the electrostatic latent image by the use of a positively chargeable developer of a developing apparatus, wherein, in said developing step, the electrostatic latent image is developed by means of the developing apparatus, which comprises:

a developer container for holding a positively chargeable developer;

a developer carrying member for carrying the positively chargeable developer held in the developer container and transporting the developer to a developing zone, wherein, said developer comprises a positively chargeable toner having a weight-average particle diameter of 5 to 10 μm, said developer carrying member has at least a substrate and a resin coat layer formed of a resin composition on the surface of the substrate;

said resin composition containing at least (I) a binder resin having a structure selected from the group consisting of an —$NH_2$ group, an =NH group and an —NH— linkage, (II) a conductive fine powder, (III) spherical particles having a number-average particle diameter of from 0.3 μm to 30 μm and (IV) a quaternary ammonium salt compound which is positively chargeable to iron powder, represented by the following general formula:

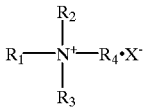

wherein $R_1$, $R_2$, $R_3$ and $R_4$ each represent a member selected from the group consisting of an alkyl group, an aryl group, and an aralkyl group, and may be the same or different from one another; and $X^-$ represents an anion.

81. The method according to claim 80, wherein said spherical particles have a number-average particle diameter of from 2 μm to 20 μm.

82. The method according to claim 80, wherein said spherical particles have a true density of 3 g/cm$^3$ or lower.

83. The method according to claim 80, wherein said spherical particles have a true density of 2.7 g/cm$^3$ or lower.

84. The method according to claim 80, wherein said spherical particles have a true density in the range of 0.9 g/cm$^3$ to 2.5 g/cm$^3$.

85. The method according to claim 80, wherein said spherical particles have a length/breadth ratio in the range of 1.0 to 1.5.

86. The method according to claim 80, wherein said spherical particles have a length/breadth ratio in the range of 1.0 to 1.2.

87. The method according to claim 80, wherein said spherical particles are spherical resin particles.

88. The method according to claim 87, wherein said spherical resin particles have been surface-treated with an inorganic fine powder.

89. The method according to claim 87, wherein said spherical resin particles have been surface-treated with a coupling agent.

90. The method according to claim 80, wherein said resin particles are conductive spherical particles having a true density of 3 g/cm$^3$ or lower.

91. The method according to claim 90, wherein said conductive spherical particles have a volume resistivity of $10^6$ Ω·cm or lower.

92. The method according to claim 90, wherein said conductive spherical particles have a volume resistivity in the range of $10^{-6}$ Ω·cm to $10^3$ Ω·cm.

93. The method according to claim 90, wherein said conductive spherical particles comprise spherical resin particles having been carbonized by firing.

94. The method according to claim 90, wherein said conductive spherical particles comprise spherical mesocarbon microbeads having been graphitized by firing.

95. The method according to claim 90, wherein said conductive spherical particles have been carbonized inside and graphitized outside.

96. The method according to claim 95, wherein said conductive spherical particles are particles obtained by coating a bulk-mesophase pitch on the surfaces of spherical resin particles, and heating the coated particles in an oxidizing atmosphere, followed by firing the oxidized, coated particles in an inert atmosphere or in vacuo.

97. The method according to claim 90, wherein said conductive spherical particles have been coated with at least one of a conductive metal and a conductive metal oxide.

98. The method according to claim 90, wherein said conductive spherical particles comprise spherical resin particles whose surfaces have been conductive-treated.

99. The method according to claim 98, wherein said conductive spherical particles are particles obtained by making conductive fine particles adhere to the surfaces of spherical resin particles and imparting a mechanical impact to the resultant particles.

100. The method according to claim 90, wherein said conductive spherical particles comprise spherical resin particles having conductive fine particles dispersed therein.

101. The method according to claim 100, wherein said conductive spherical particles are particles obtained by kneading a resin and conductive fine particles, cooling the resultant kneaded product to solidify, pulverizing the resultant solidified product, and sphering the resultant pulverized product by at least one of a mechanical treatment and a thermal treatment.

102. The method according to claim 80, wherein said resin particles are conductive spherical particles having a true density of 2.7 g/cm$^3$ or lower.

103. The method according to claim 80, wherein said resin particles are conductive spherical particles having a true density in the range of 0.9 g/cm$^3$ to 2.5 g/cm$^3$.

104. The method according to claim 80, wherein said resin coat layer contains resin particles in an amount of from 2 to 120 parts by weight based on 100 parts by weight of the binder resin.

105. The method according to claim 80, wherein said anion comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

106. The method according to claim 80, wherein said resin coat layer contains said quaternary ammonium salt compound in an amount of from 1 part by weight to 100 parts by weight based on 100 parts by weight of the binder resin.

107. The method according to claim 80, wherein said binder resin is a resin selected from the group consisting of a phenol resin, a polyamide resin, and a polyurethane resin.

108. The method according to claim 80, wherein said resin coat layer has a center-line surface roughness Ra in the range of 0.2 to 3.5.

109. The method according to claim 80, wherein said positively chargeable developer is a one-component type developer having a positively chargeable magnetic toner.

110. The method according to claim 80, wherein said positively chargeable developer is a one-component type developer having a positively chargeable nonmagnetic toner.

111. The method according to claim 80, wherein said positively chargeable toner contains a release agent.

112. The method according to claim 80, wherein said positively chargeable toner contains a positive charge control agent.

113. The method according to claim 80, wherein said positively chargeable developer comprises a positively chargeable toner and an inorganic fine powder externally added to the positively chargeable toner.

114. The method according to claim 80, wherein said positively chargeable developer comprises the positively chargeable toner and an external additive treated with a liquid lubricant.

115. The method according to claim 80, wherein the thickness of the positively chargeable developer layer to be formed on said developer carrying member is smaller than the minimum gap between the surface of said developer carrying member and the surface of an electrostatic latent image bearing member.

116. The method according to claim 80, wherein in the developing step a bias voltage is applied to said developer carrying member to develop the electrostatic latent image.

117. The method according to claim 116, wherein said bias voltage has an alternating bias voltage on which a direct current component has been superimposed.

118. The method according to claim 80, wherein said latent image developing member comprises an electrophotographic photosensitive member.

119. The method according to claim 80, wherein said positively chargeable toner has, in its particle size distribution, a weight-average diameter in the range of 5 $\mu$m to 10 $\mu$m.

* * * * *

UNITED STATES PATENT AND TRADEMARK OFFICE

CERTIFICATE OF CORRECTION

PATENT NO. : 6,391,511 B1
DATED : May 21, 2002
INVENTOR(S) : Naoki Okamoto et al.

It is certified that error appears in the above-identified patent and that said Letters Patent is hereby corrected as shown below:

Column 1,
Line 33, “are used” should read -- is used --;
Line 43, “required,” should read -- required; --; and
Line 59, “toner, then,” should read -- toner. Then, --.

Column 2,
Line 25, “performs” should read -- perform --.

Column 3,
Line 50, “making less occur,” should read -- minimizing --.

Column 4,
Line 43, “state” should read -- state wherein --.

Column 7,
Line 21, “worn” should read -- worn down --; and
Line 58, “supported” should read -- is supported --.

Column 9,
Line 47, “can not” should read -- cannot --.

Column 13,
Line 17, “aggregated” should read -- aggregated to --.

Column 15,
Line 36, “member,” should read -- member; --;
Line 43, “more” should read -- further --;
Line 49, “above” should read -- above, --;
Lines 52 and 54, “or” should read -- or with --.

Column 16,
Line 46, “shaked” should read -- shaken --.

Column 17,
Line 24, “completely,” should read -- completely; --; and
Line 27, “with a” should read -- with an --.

Column 19,
Line 4, “can not” should read -- cannot --; and “well” should read -- sufficiently --.

UNITED STATES PATENT AND TRADEMARK OFFICE

CERTIFICATE OF CORRECTION

PATENT NO. : 6,391,511 B1
DATED : May 21, 2002
INVENTOR(S) : Naoki Okamoto et al.

It is certified that error appears in the above-identified patent and that said Letters Patent is hereby corrected as shown below:

Column 21,
Line 28, “(xylylene” should read -- (-xylene --;
Line 29, “xylilene” should read -- (-xylene --; and
Line 47, “less change” should read -- change less --.

Column 22,
Line 21, “a too small” should read -- too small a --;
Line 22, “tends” should read -- tend --; and
Lines 27 and 31, “truely” should read -- truly --.

Column 23,
Line 50, “less adhere” should read -- adhere less --.

Column 24,
Line 46, “more” should read -- further --; and
Line 65, “adhered,” should read -- adhered; --.

Column 26,
Line 22, “a too small” should read -- too small a --;
Line 44, “can not” should read -- cannot --; and “well” should read -- sufficiently --; and
Line 52, “because” should read -- especially because --; and “especially” should be deleted.

Column 27,
Line 15, “can not” should read -- cannot --; and “well” should read -- sufficiently --.

Column 28,
Line 5, “conplicacy” should read -- complexity --;
Line 13, “back” should read -- back- --; and
Line 22, “back ground” should read -- background --.

Column 30,
Line 18, “one” should read -- one of the --.

Column 32,
Line 9, “muller,” should read -- muller; --.

UNITED STATES PATENT AND TRADEMARK OFFICE

CERTIFICATE OF CORRECTION

PATENT NO. : 6,391,511 B1
DATED : May 21, 2002
INVENTOR(S) : Naoki Okamoto et al.

It is certified that error appears in the above-identified patent and that said Letters Patent is hereby corrected as shown below:

Column 33,
Line 6, "Phenol" should be deleted;
Line 7, "resin intermediate (solid content: 50%) produced in the" should be deleted;
Line 8, "presence of ammonia as a catalyst." should be deleted; and
In the Table, "200 parts" should read -- Phenol resin intermediate (solid content: 50%) produced in the presence of ammonia as a catalyst 200 parts --.

Column 34,
Line 29, "glance." should read -- a glance. --.

Column 38,
Line 17, "1.06" should read -- 1.06. --.

Column 45,
Table 3-1, Example 14, " G A" should read -- C A --;
Table 3-1, Example 7, "1.33 1.o" should read -- 1.33 1.0 --;
Table 3-1, Example 6, "13.9 1.0O" should read -- 13.9 1.00 --.

Column 48,
Line 44, "$10^{-6}\Omega m$" should read -- $10^{-6}\Omega \cdot cm$ --.

Column 49,
Line 19, "ions," should read -- ion, --.

Column 50,
Line 37, "—NH linkage," should read -- —NH—linkage --; and
Line 59, "$3q/cm^3$" should read -- $3g/cm^3$ --.

Column 51,
Line 29, "claim 51," should read -- claim 55, --.

Column 52,
Line 2, "ions," should read -- ion, --.

UNITED STATES PATENT AND TRADEMARK OFFICE

CERTIFICATE OF CORRECTION

PATENT NO. : 6,391,511 B1
DATED : May 21, 2002
INVENTOR(S) : Naoki Okamoto et al.

It is certified that error appears in the above-identified patent and that said Letters Patent is hereby corrected as shown below:

Column 54,
Line 43, "ions," should read -- ion, --.

Signed and Sealed this

Sixth Day of May, 2003

JAMES E. ROGAN
*Director of the United States Patent and Trademark Office*